US010437196B2

(12) United States Patent
Kutsuwada

(10) Patent No.: US 10,437,196 B2
(45) **Date of Patent: *Oct. 8, 2019**

(54) COOLING DEVICE AND IMAGE FORMING APPARATUS INCORPORATING THE COOLING DEVICE

(71) Applicant: Akio Kutsuwada, Tokyo (JP)

(72) Inventor: Akio Kutsuwada, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/213,003

(22) Filed: Dec. 7, 2018

(65) Prior Publication Data

US 2019/0107808 A1 Apr. 11, 2019

Related U.S. Application Data

(63) Continuation of application No. 15/453,742, filed on Mar. 8, 2017, now Pat. No. 10,175,646.

(30) Foreign Application Priority Data

Mar. 17, 2016 (JP) ..... 2016-053716
Apr. 12, 2016 (JP) ..... 2016-079469

(51) Int. Cl.
*G03G 15/20* (2006.01)
*G03G 21/20* (2006.01)

(52) U.S. Cl.
CPC ..... *G03G 21/206* (2013.01); *G03G 15/2021* (2013.01); *G03G 21/20* (2013.01)

(58) Field of Classification Search
CPC ..... G03G 15/2021; G03G 15/6573; G03G 2215/00426
See application file for complete search history.

(56) References Cited

U.S. PATENT DOCUMENTS

2014/0186080 A1* 7/2014 Ikeda ..... G03G 15/6573 399/341

* cited by examiner

*Primary Examiner* — Erika J Villaluna
(74) *Attorney, Agent, or Firm* — Duft & Bornsen, PC

(57) ABSTRACT

A cooling device, which is included in an image forming apparatus, includes first and second conveying belts facing each other to hold and convey a recording medium therebetween, a first cooling body in contact with the first conveying belt to cool the recording medium, a second cooling body in contact with the second conveying belt to cool the recording medium, a heat dissipating body to dissipate heat of each cooling medium absorbed from the first and second cooling bodies, a cooling medium entering passage to flow each cooling medium from the heat dissipating body toward respective inlets of the first and second cooling bodies, and a cooling medium exiting passage to merge each cooling medium discharged from respective outlets of the first and second cooling bodies and flow the merged cooling medium to the heat dissipating body.

10 Claims, 13 Drawing Sheets

COOLING DEVICE AND IMAGE FORMING APPARATUS INCORPORATING THE COOLING DEVICE

CROSS-REFERENCE TO RELATED APPLICATION

This patent application is based on and claims priority pursuant to 35 U.S.C. § 119(a) to Japanese Patent Application Nos. 2016-053716, filed on Mar. 17, 2016, and 2016-079469, filed on Apr. 12, 2016, in the Japan Patent Office, the entire disclosures of each of which are hereby incorporated by reference herein. This patent application is a continuation of co-pending U.S. patent application Ser. No. 15/453,742 (filed on Mar. 8, 2017) titled "COOLING DEVICE AND IMAGE FORMING APPARATUS INCORPORATING THE COOLING DEVICE," which is hereby incorporated by reference.

BACKGROUND

Technical Field

This disclosure relates to a cooling device and an image forming apparatus incorporating the cooling device.

Related Art

Various types of cooling devices are known to include conveying belts and respective cooling members. A recording medium is held by the conveying belts from both a front side and a back side and is conveyed in a sheet conveying direction. The cooling members are disposed inside the respective conveying belts to cool the recording medium from the front side and the back side while holding and conveying the recording medium.

For example, a known cooling device includes cooling members disposed facing each other, each of the cooling members include multiple cooling medium flowing passages inside. A cooling medium passes through the multiple cooling medium flowing passages in the cooling members alternately. Specifically, after having passed through one of the multiple cooling medium flowing passages of one cooling member, the cooling medium flows into one of the multiple cooling medium flowing passages of the other cooling member. Thereafter, the cooling medium flows through the cooling medium flowing passage in the one cooling member and the cooling medium flowing passage in the other cooling member alternately.

Therefore, the temperature of the cooling medium becomes different in the cooling medium flowing passages, which are disposed adjacent to each other and defined by the cooling members. Further, when the cooling medium flowing passages are formed so as to extend in a meander shape in the cooling members, a difference of the temperatures of adjacent portions of a meandering cooling medium flowing passage in the cooling member becomes greater than the difference of temperatures of the cooling medium flowing passage of the known cooling device. Further, the cooling medium first flows in the meandering flowing passage of one cooling member facing one of the front side and the back side of a recording medium, and then enters the meandering flowing passage of the other cooling member facing the other of the front side and the back side of the recording medium. Therefore, a difference in temperatures of the one cooling member and the other cooling member becomes greater.

SUMMARY

At least one aspect of this disclosure provides a cooling device including a first conveying belt, a first cooling body, a second conveying belt, a second cooling body, a heat dissipating body, a cooling medium entering passage, and a cooling medium exiting passage. The first conveying belt is disposed facing one side of a recording medium while the recording medium is conveyed in a sheet conveying direction. The first cooling body includes a first liquid inlet through which a cooling medium enters inside, a first liquid outlet through which the cooling medium exits outside, and a first liquid flowing passage through which the cooling medium flows between the first liquid inlet and the first liquid outlet. The first cooling body is configured to contact an inner circumferential surface of the first conveying belt and cool the recording medium. The second conveying belt is disposed facing the other side of the recording medium while the recording medium is conveyed in the sheet conveying direction. The second cooling body includes a second liquid inlet through which the cooling medium enters inside, a second liquid outlet through which the cooling medium exits outside, and a second liquid flowing passage through which the cooling medium flows between the second liquid inlet and the second liquid outlet. The second cooling body is configured to contact an inner circumferential surface of the second conveying belt and cool the recording medium. The heat dissipating body is configured to dissipate heat of the cooling medium discharged from the first cooling body and the second cooling body. The cooling medium entering passage is configured to flow the cooling medium dissipated by the heat dissipating body to the first liquid inlet and the second liquid inlet, respectively. The cooling medium exiting passage is configured to merge the cooling medium discharged from the first liquid outlet and the second liquid outlet and flow the merged cooling medium to the heat dissipating body.

Further, at least one aspect of this disclosure provides an image forming apparatus including an image forming device configured to form an image on a recording medium, and the above-described cooling device.

DETAILED DESCRIPTION

Figure 1:
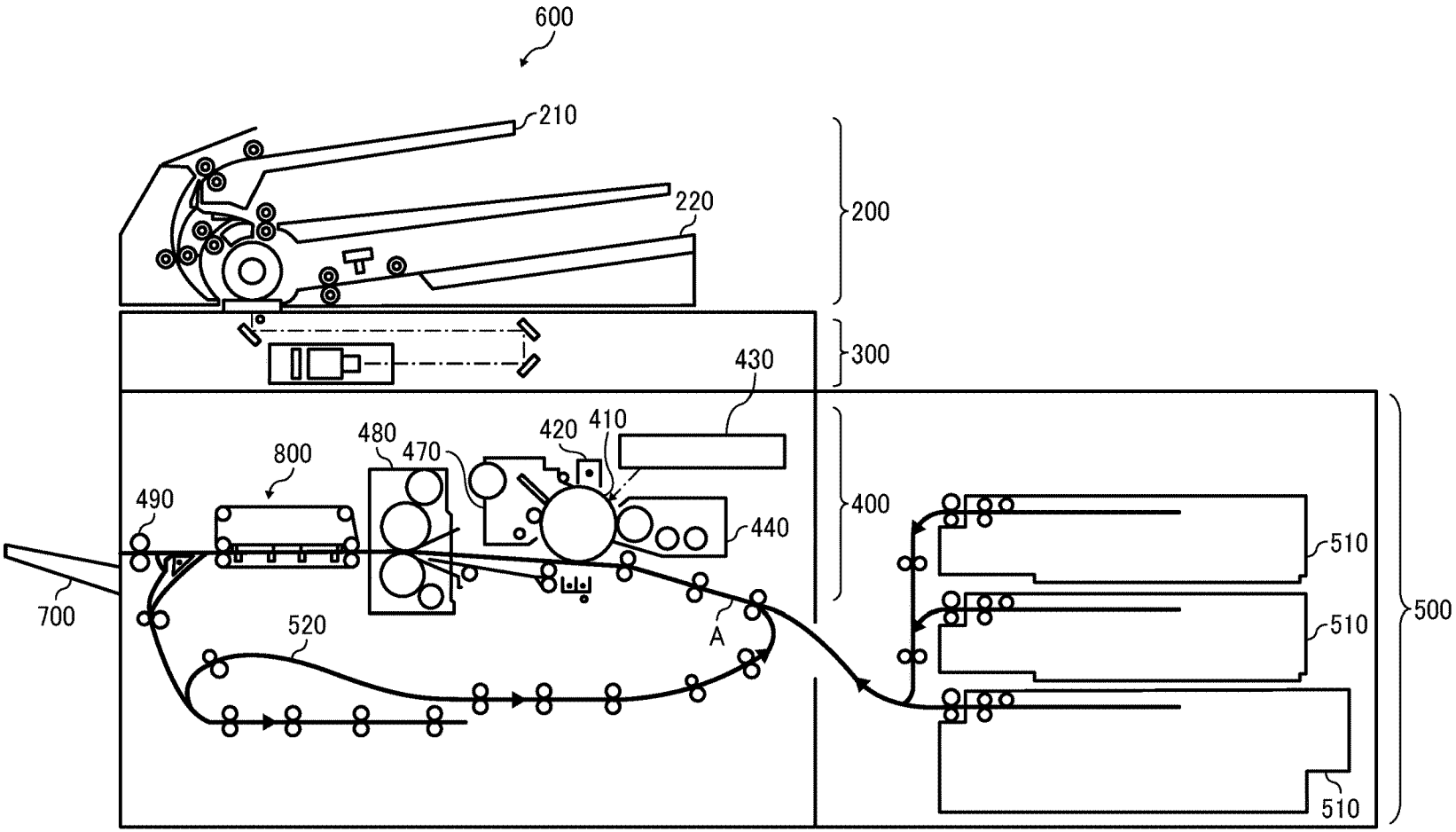
FIG. 1 is a cross sectional view illustrating a schematic configuration of an image forming apparatus according to the present embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

A description is given of an image forming apparatus 600 according to an embodiment of this disclosure, with reference to the drawings.

It is to be noted that identical parts are given identical reference numerals and redundant descriptions are summarized or omitted accordingly.

The image forming apparatus 600 may be a copier, a facsimile machine, a printer, a multifunction peripheral or a multifunction printer (MFP) having at least one of copying, printing, scanning, facsimile, and plotter functions, or the like. According to the present embodiment, the image forming apparatus 600 is an electrophotographic printer that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying passage to a downstream side thereof; the term "width direction" indicates a direction basically perpendicular to the sheet conveying direction.

At first, a description is given of a basic configuration of the image forming apparatus 600 according to the present embodiment of this disclosure.

FIG. 1 is a schematic diagram illustrating the image forming apparatus 600 according to an embodiment of this disclosure.

The image forming apparatus 600 includes functions of a copier, printer, facsimile machine, and so forth to form a monochrome image on a recording medium by electrophotography. It is to be noted that an image forming apparatus according to the present embodiment of this disclosure may also be applied to an apparatus that forms a color image or may simply function as a printer.

As illustrated in FIG. 1, the image forming apparatus 600 includes an original document conveying device 200, an original document reading device 300, an image forming device 400, a sheet feeding device 500, and an output tray 700.

It is to be noted that the image forming apparatus 600 further includes a sheet conveying passage A. The sheet conveying passage is configured to convey a recording medium from the sheet feeding device 500 to the output tray 700 via the image forming device 400. The sheet conveying passage A is defined by various rollers, guide plates, and conveying belts disposed at respective predetermined positions.

Further, the image forming apparatus 600 can be coupled with an external device, for example, a personal computer, so as to obtain image data from the external device.

The original document conveying device 200 is configured to convey an original document or original documents to the original document reading device 300 so as to read or scan the original documents continuously. The original document conveying device 200 includes an original document feed tray 210 and an original document ejection tray 220. The original document conveying device 200 conveys each of the original documents set in the original document feed tray 210 to a reading position on an upper face of the original document reading device 300. After the original document reading device 300 has read the original document conveyed to the reading position, the original document is conveyed to the original document ejection tray 220.

The original document reading device 300 optically reads an image on the original document, converts image data of the image on the original document into an analog signal, and converts the analog signal to a digital signal.

The image forming device 400 includes a drum-shaped photoconductor 410, a charging unit 420, an image writing unit 430, a developing unit 440, a transfer unit 450, a separating unit 460, and a cleaning unit 470. The charging unit 420, the image writing unit 430, the developing unit 440, the transfer unit 450, the separating unit 460, and the cleaning unit 470 function as image formation functioning parts and are disposed around the photoconductor 410. The image forming device 400 further includes a fixing unit 480, a cooling device 800, and a sheet ejecting roller 490.

The charging unit 420 applies a predetermined amount of voltage to the photoconductor 410 so that the surface of the photoconductor 410 is uniformly charged. The image writing unit 430 emits a laser light beam to the photoconductor 410 based on the image data read by the original document reading device 300, and form an electrostatic latent image on the surface of the photoconductor 410.

The developing unit 440 performs reversal development to develop the electrostatic latent image formed on the photoconductor 410 into a visible toner image on the photoconductor 410. The recording medium is fed such that the movement of the recording medium is synchronized with rotation of the photoconductor 410 on which the toner image is formed. The transfer unit 450 applies a predetermined voltage from the back face side of the conveying belt that conveys the recording medium, so that the toner image formed on the photoconductor 410 can be transferred onto the recording medium.

The separating unit 460 electrically discharges the recording medium on which the toner image is transferred, so as to separate the recording medium from the photoconductor 410. Then, the recording medium having the toner image thereon is conveyed to the fixing unit 480.

The fixing unit 480 applies heat to cause toner on the toner image transferred on the recording medium to melt and pressure to press the recording medium. By so doing, the toner image is fixed to the recording medium. The recording medium is cooled by the cooling device 800 and then conveyed to the output tray 700 to be stacked thereon.

When forming images on both the front side and back side of the recording medium, after the recording medium has been cooled by the cooling device 800, the sides of the recording medium is turned over or reversed in a reversing passage 520 and is fed to the image forming device 400 again.

The sheet feeding device 500 includes multiple sheet containers 510 corresponding various types of recording media. A predetermined recording medium accommodated in a corresponding one of the multiple sheet containers 510 is fed to the image forming device 400 through a sheet conveying passage A.

Figure 2:
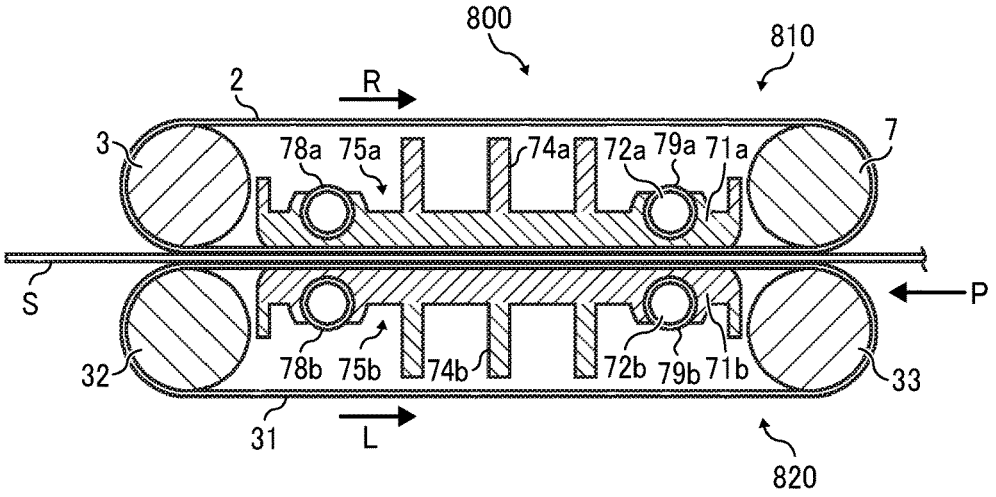
FIG. 2 is a diagram illustrating a cooling device according to the present embodiment of this disclosure, in cross section along a conveying direction of a recording medium.
Figure 3:
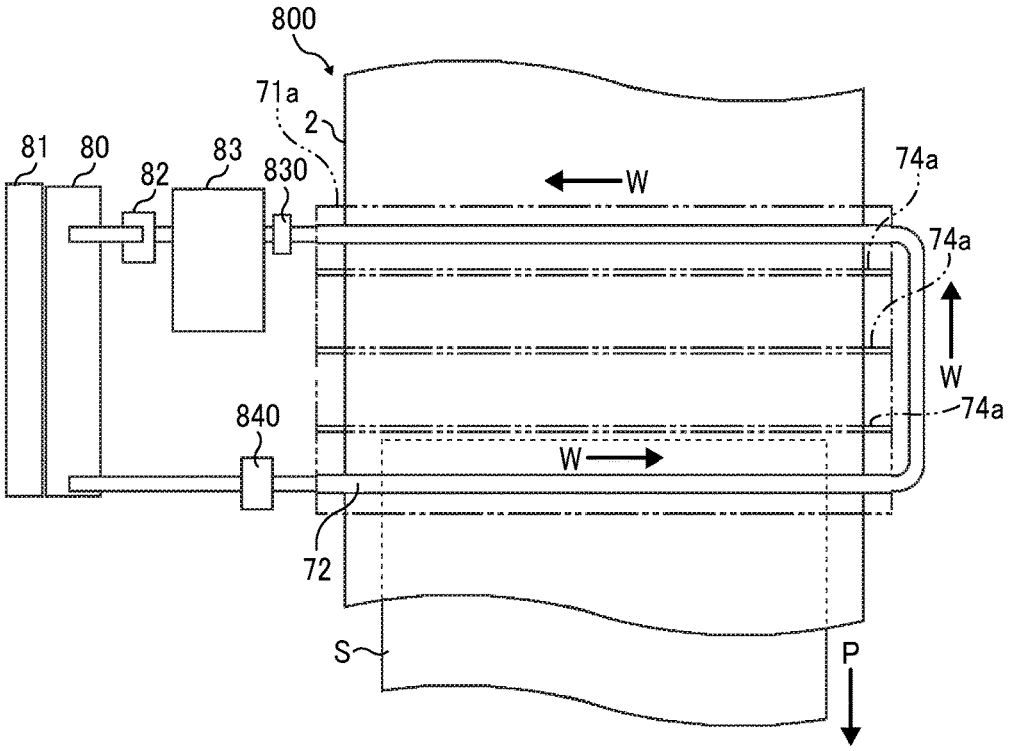
FIG. 3 is a plan view illustrating the cooling device of FIG. 2, viewed from top.

FIG. 2 is a diagram illustrating the cooling device 800 according to the present embodiment of this disclosure, in cross section along the sheet conveying direction of a recording medium. FIG. 3 is a plan view illustrating the cooling device 800 of FIG. 2, viewed from the top.

It is to be noted that a reference letter "S" indicates a recording medium and an arrow "P" indicates the sheet conveying direction of the recording medium S.

As illustrated in FIGS. 2 and 3, the cooling device 800 includes an upper side conveying unit 810 that functions as a first conveyor and a lower side conveying unit 820 that functions as a second conveyor.

The upper side conveying unit 810 includes an upper side conveying belt 2 and a first cooling plate 71*a*. The upper side conveying belt 2 functions as a first conveying belt disposed on one of the front side and the back side of the recording medium S. The first cooling plate 71*a* functions as a cooling member disposed in contact with an inner circumference of the upper side conveying belt 2 to cool the recording medium S. The first cooling plate 71*a* is a part of a cooling unit 75*a*.

The lower side conveying unit 820 is disposed facing the upper side conveying unit 810 to hold and convey the recording medium S together with the upper side conveying belt 2. The lower side conveying unit 820 includes a lower side conveying belt 31 to convey the recording medium S while holding the recording medium S between the upper side conveying belt 2 and the lower side conveying belt 31.

The cooling device 800 includes the upper side conveying unit 810 including the upper side conveying belt 2 and the cooling unit 75*a*, and the lower side conveying unit 820 including the lower side conveying belt 31 and a cooling unit 75*b*.

The upper side conveying belt 2 of the upper side conveying unit 810 is an endless belt stretched taut by multiple rollers on a horizontal plane extending in a direction perpendicular to the sheet conveying direction of the recording medium S. The upper side conveying belt 2 is a heat conductive member between the first cooling plate 71*a* and the recording medium S, and therefore preferably includes a material having a high thermal conductivity or a thin film (for example, a thin stainless belt or a polyimide film). The multiple rollers that stretch the upper side conveying belt 2 taut (for example, a tension roller) include a drive roller 3 and a driven roller 7.

In the upper side conveying unit 810, the drive roller 3 that functions as a first tension body to stretch the upper side conveying belt 2 with tension is provided at a downstream side of the sheet conveying direction of the recording medium S. In addition, the drive roller 3 is a roller to drive and rotate the upper side conveying belt 2 in a clockwise direction indicated by arrow R in FIG. 2. The drive roller 3 is a metallic core bar wound around by an elastic member such as rubber.

The driven roller 7 supports the upper side conveying belt 2 and is rotated by a rotation force of the upper side conveying belt 2. The driven roller 7 includes the same configuration as the drive roller 3 or a metallic roller.

The driven roller 7 is a tension roller to bias the upper side conveying belt 2 toward the outside from the inside of the loop. Application of the tension force to the upper side conveying belt 2 presses the upper side conveying belt 2 against the drive roller 3 to generate a frictional force. The rotation force of the drive roller 3 is transmitted to the upper side conveying belt 2, so that the upper side conveying belt 2 rotates.

The lower side conveying belt 31 of the lower side conveying unit 820 is an endless belt to convey the recording medium S while holding the recording medium S together with the upper side conveying belt 2. The lower side conveying belt 31 is disposed below the upper side conveying belt 2. The lower side conveying belt 31 may include the same material as the upper side conveying belt 2 or an elastic or flexible rubber material.

The multiple rollers that stretch the lower side conveying belt 31 taut (for example, a tension roller) include a drive roller 32 and a driven roller 33. The drive roller 32 functions as a second tension body disposed at a downstream side in the sheet conveying direction of the recording medium S. The driven roller 33 functions as a fourth tension body disposed at an upstream side in the sheet conveying direction. The drive roller 32 is driven to rotate the lower side conveying belt 31 in a counterclockwise direction indicated by arrow L in FIG. 2. The drive roller 32 may be the same roller as the drive roller 3 provided to the upper side conveying unit 810. A rotation force is transmitted to the drive roller 32 via engagement of a driving force transmission gear 11 attached to the drive roller 3 with a drive gear 43 mounted on the drive roller 32, so as to rotate the drive roller 32 in the counterclockwise direction (see FIG. 4).

The driven roller 7 is a tension roller to bias the lower side conveying belt 31 toward the outside from the inside of the loop. Application of the tension force to the lower side conveying belt 31 presses the lower side conveying belt 31 against the drive roller 32 to generate a frictional force. The rotation force of the drive roller 32 is transmitted to the lower side conveying belt 31, so that the lower side conveying belt 31 rotates.

As illustrated in FIGS. 2 and 3, the cooling units 75*a* and 75*b* include a first cooling tube 72*a*, and a second cooling tube 72*b*, each of which functions as a cooling medium flowing passage, a liquid tank 83, a pump 82 that functions as a medium supplier, a radiator 80 that functions as a heat dissipating part, and a fan 81 that functions as a cooling part.

The first cooling plate 71*a* and second cooling plate 71*b* are formed of a metallic material having high thermal conductivity, for example, aluminum and copper. Respective heat absorbing surfaces of the first cooling plate 71*a* and second cooling plate 71*b* are flat plates and contact the upper side conveying belt 2. The first cooling plate 71*a* is disposed inside the loop of the upper side conveying belt 2 and between the drive roller 3 and the driven roller 7. A downstream end and an upstream end of the first cooling plate 71*a* in the sheet conveying direction of the recording medium S extend close to the drive roller 3 and the driven roller 7, respectively, and therefore the cooling effect of the recording medium S that passes through the cooling device 800 can be enhanced.

The first cooling plate 71*a* and the second cooling plate 71*b* include multiple fitting portions to which the first cooling tube 72*a* and second cooling tube 72*b* fit, respectively. In the present embodiment, two fitting portions are provided in the configuration according to the present embodiment of this disclosure. The fitting portions are arranged on a horizontal plane in a direction perpendicular to the sheet conveying direction of the recording medium S. The first cooling tube 72*a* is disposed immediately above the second cooling tube 72*b*. Consequently, the cooling device 800 can cool the recording medium S.

Further, multiple radiation fins, which are first radiation fins 74*a* and second radiation fins 74*b*, are provided to the first cooling plate 71*a* and the second cooling plate 71*b*, respectively. The first cooling plate 71*a* includes a first liquid inlet 78*a*, a first liquid outlet 79*a*, and a first liquid flowing passage. Further, the second cooling plate 71*b* includes a second liquid inlet 78*b*, a second liquid outlet 79*b*, and a second liquid flowing passage. Specifically, three first radiation fins 74*a* are disposed at certain intervals between the first liquid inlet 78*a* located at an upstream side of a cooling medium flowing direction of the first cooling tube 72*a* and the first liquid outlet 79*a* located at a downstream side of the cooling medium flowing direction of the first cooling tube 72*a*. Similarly, three second radiation fins 74*b* are disposed at certain intervals between the second liquid inlet 78*b* located at an upstream side of the cooling medium flowing direction of the second cooling tube 72*b* and the second liquid outlet 79*b* located at a downstream side of the cooling medium flowing direction of the second cooling tube 72*b*. The multiple radiation fins, i.e., the first radiation fins 74*a* and the second radiation fins 74*b* are arranged on a horizontal plane in the direction perpendicular to the sheet conveying direction of the recording medium S.

An air flowing passage is formed between each two of the radiation fins 74*a* disposed adjacent to each other and between each two of the radiation fins 74*b* disposed adjacent to each other. When heat of the recording medium S is moved from the recording medium S to the respective heat absorbing surfaces of the first cooling plate 71*a* and the second cooling plate 71*b*, there is a case in which the heat transfer may be performed in a region with no cooling medium flowing passage provided between the first cooling tube 72*a* and the second cooling tube 72*b* disposed adjacent to each other. In this case, when the respective heat absorbing surfaces of the first cooling tube 72*a* and the second cooling tube 72*b* receives heat from the recording medium S, not only the heat is taken by the cooling medium flowing in the first cooling tube 72*a* and the second cooling tube 72*b* but also the heat is released via the radiation fins 74*a* and 74*b*. With this configuration, when compared with a cooling unit provided with radiation fins or cooling tubes, the cooling effect of the cooling device 800 becomes higher.

The first cooling tube 72*a* and the second cooling tube 72*b* are tubular members formed of a metallic material having high thermal conductivity, for example, aluminum and copper. The first cooling tube 72*a* and the second cooling tube 72*b* form respective cooling medium flowing passages through which the cooling medium flows in a direction intersecting the sheet conveying direction of the recording medium S. The cooling medium is, for example, a liquid that contains water as main component and an antifreeze (e.g., propylene glycol or ethylene glycol) to reduce the freezing point, and an antirust (e.g., phosphate medium: phosphoric acid potassium salt, or inorganic potassium salt) as additives.

The liquid tank 83 contains the cooling medium.

The pump 82 is controlled by a controller (see FIG. 13). After the cooling medium is supplied from the liquid tank 83 to the radiator 80, the cooling medium is circulated in the first cooling tube 72*a* and the second cooling tube 72*b*.

The fan 81 is disposed near an inlet port that communicates the image forming apparatus 600 with an external device. The fan 81 intakes air from the inlet port and guides the air to the radiator 80. Heat of the cooling medium is dissipated by passing through the radiator 80. Then, the cooling medium is branched at a flowing passage branching portion 840 to be separated to the first cooling tube 72*a* and the second cooling tube 72*b*. By contrast, after the cooling medium has been discharged from an outlet port of a first cooling tube 72*a*' and a second cooling tube 72*b*', the cooling medium is collected at a flowing passage gathering portion 830 to be merged into one flowing passage. Thereafter, the cooling medium is conveyed to the liquid tank 83.

It is to be noted that the first cooling tube 72*a*, the second cooling tube 72*b*, and the flowing passage branching portion 840 form a cooling medium entering passage 890. Further, the first cooling tube 72*a*', the second cooling tube 72*b*', and the flowing passage gathering portion 830 form a cooling medium exiting passage 880.

In image formation, the cooling medium flows in the cooling medium flowing passages defined by the first cooling tube 72*a* (72*a*') and the second cooling tube 72*b* (72*b*'). In order to do so, the pump 82 supplies the cooling medium from the liquid tank 83 to the first cooling tube 72*a* (72*a*') and the second cooling tube 72*b* (72*b*'). Therefore, the recording medium supplied to the first cooling tube 72*a* and the second cooling tube 72*b* flows inside the first cooling tube 72*a* and the second cooling tube 72*b* in an extreme downstream side in the sheet conveying direction of the recording medium S and is discharged from the first cooling tube 72*a*' and the second cooling tube 72*b*' in an extreme upstream side in the sheet conveying direction. Then, the cooling medium is stored in the liquid tank 83.

It is to be noted that the first cooling tube and the second cooling tube disposed on the cooling medium supplying side are referred to as the first cooling tube 72*a* and the second cooling tube 72*b* and on the cooling medium discharging side are basically referred to as the first cooling tube 72*a*' and the second cooling tube 72*b*'. However, "the first cooling tube 72*a*" and "the second cooling tube 72*b*" occasionally include both the first cooling tube 72*a* and the second cooling tube 72*b* on the cooling medium supplying side and the first cooling tube 72*a*' and the second cooling tube 72*b*' on the cooling medium discharging side.

As described above, the pump 82 supplies the cooling medium to the first cooling tube 72*a* and the second cooling tube 72*b* such that the cooling medium flows from the downstream side to the upstream side inside the first cooling tube 72*a* and the second cooling tube 72*b* in the sheet conveying direction of the recording medium.

It is to be noted that arrow "W" indicates the cooling medium flowing direction in which the cooling medium flows in the first cooling tube 72*a* and the second cooling tube 72*b*, for example.

Figure 4:
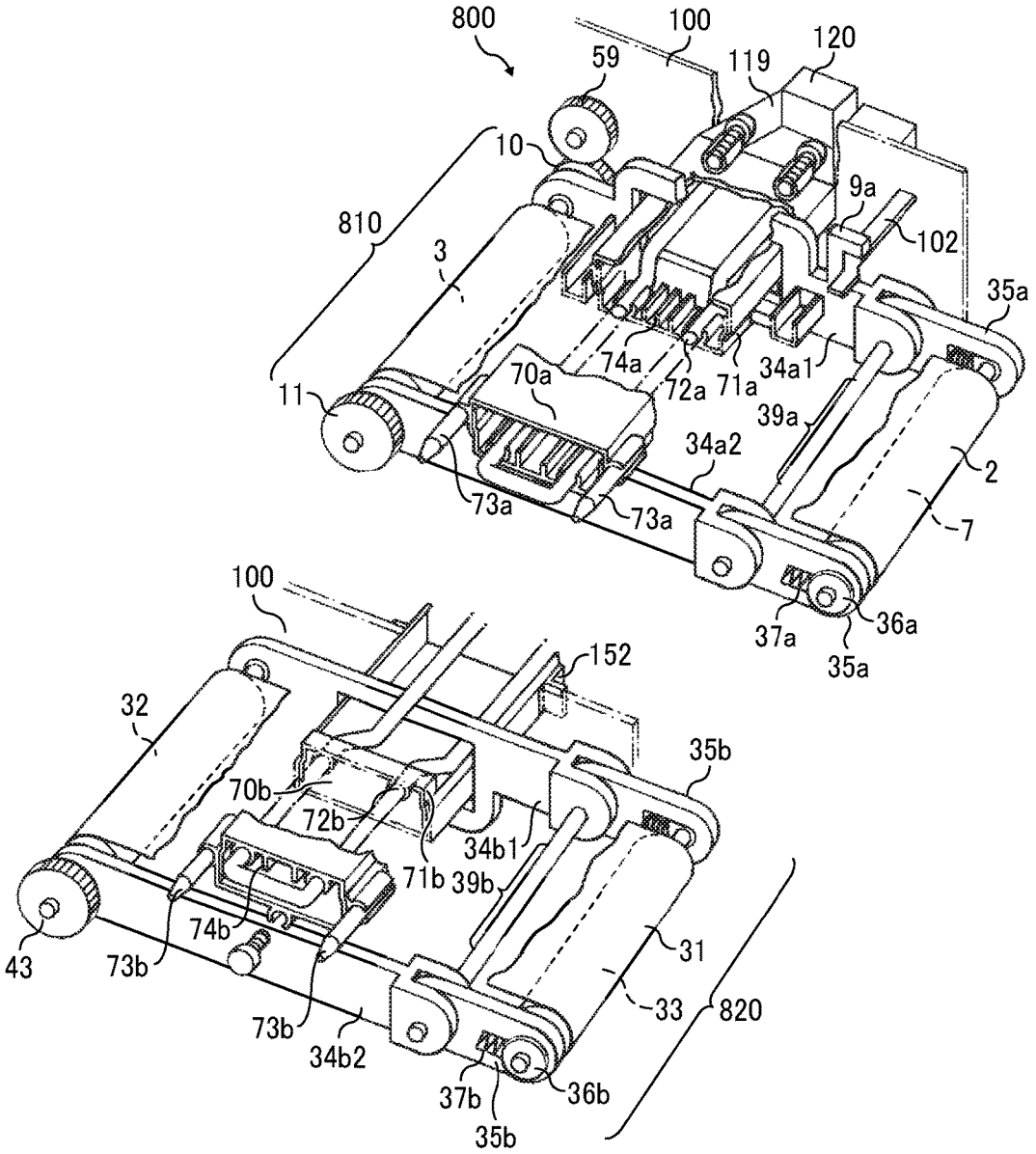
FIG. 4 is a perspective view illustrating a schematic configuration of the cooling device.
Figure 5A:
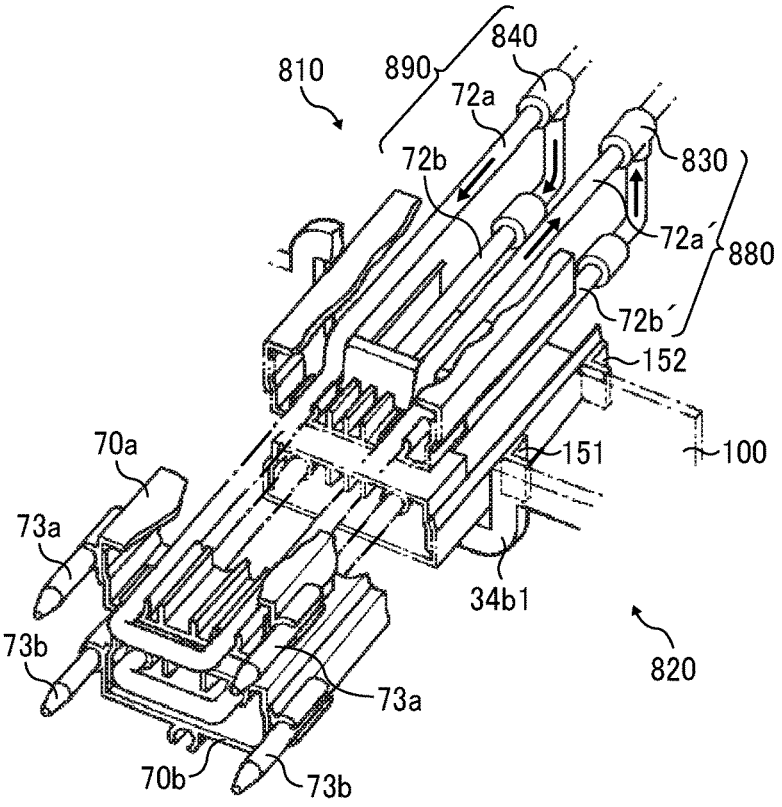
FIG. 5A is a perspective view illustrating a schematic configuration of an upper conveying unit and a lower conveying unit.
Figure 5B:
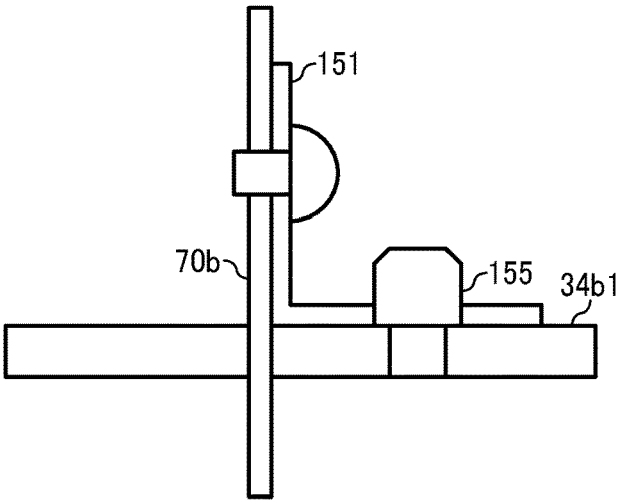
FIG. 5B is an enlarged plan view illustrating a bracket of the upper conveying unit and the lower conveying unit of FIG. 5A.
Figure 6:
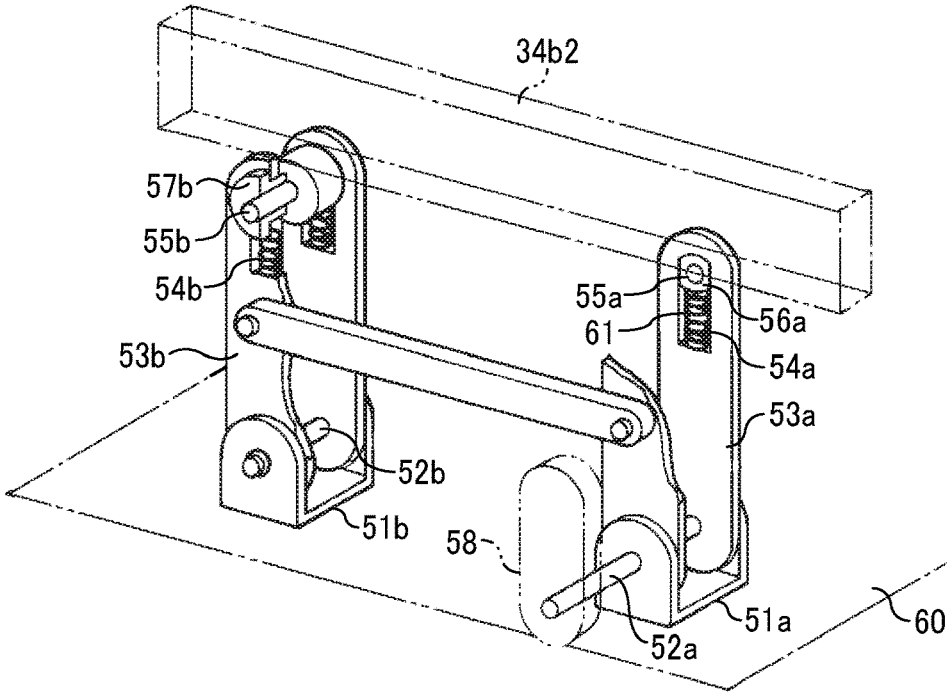
FIG. 6 is a perspective view illustrating a schematic configuration of a support supporting a lower side front plate.
Figure 7:
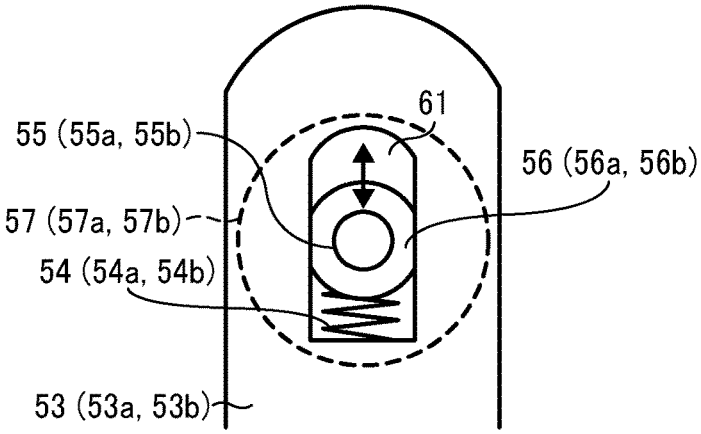
FIG. 7 is an enlarged view illustrating a schematic configuration of the support supporting the lower side front plate.
Figure 8:
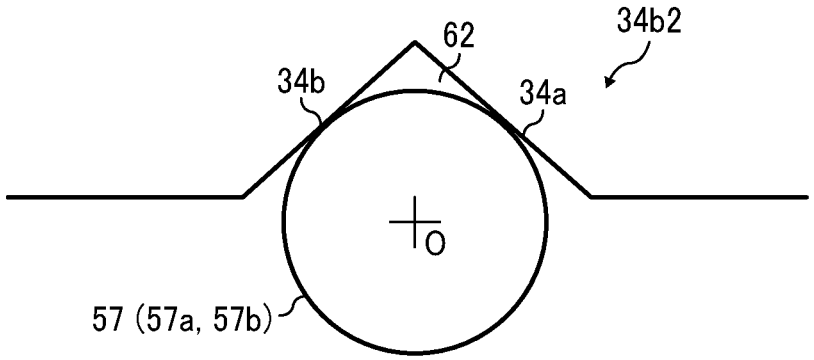
FIG. 8 is an enlarged view illustrating a schematic configuration of a recess of the lower side front plate, which is engaged with the support illustrated in FIG. 7.
Figure 9:
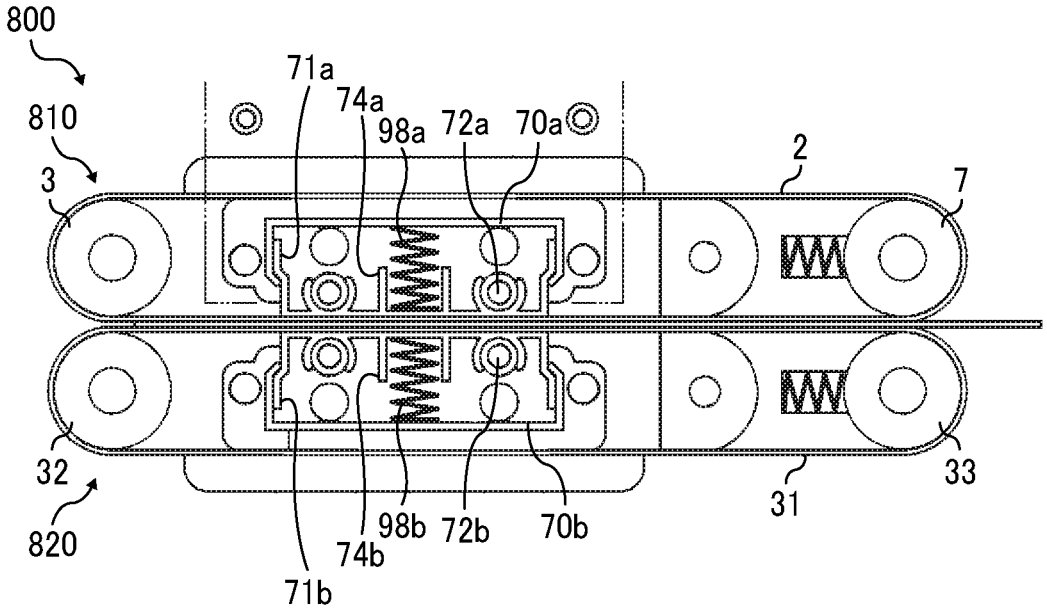
FIG. 9 is a cross sectional view illustrating the upper conveying unit and the lower conveyance unit.
Figure 10:
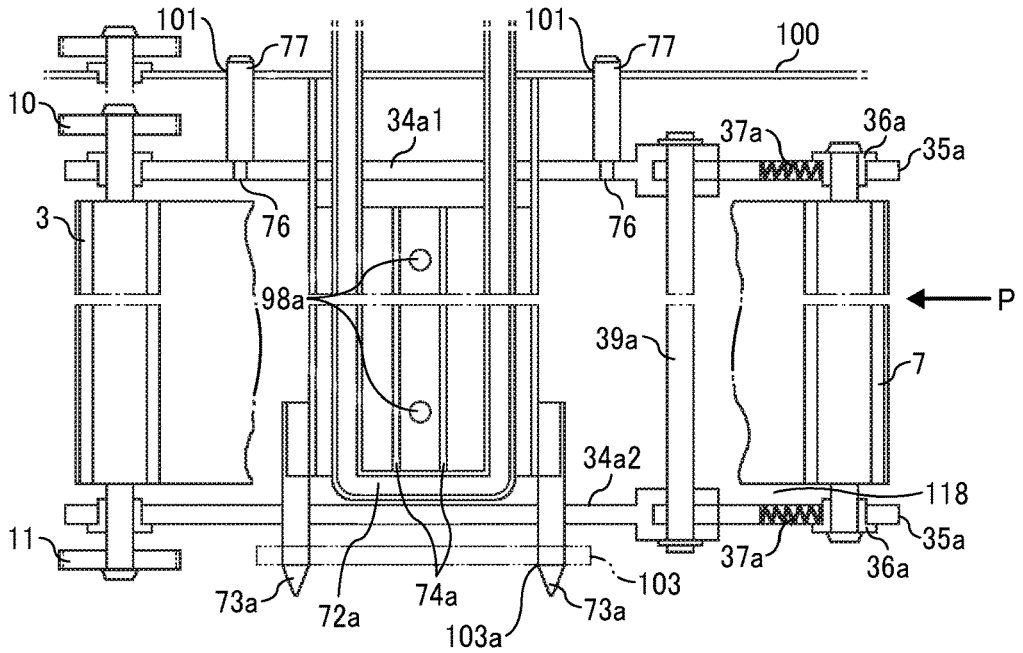
FIG. 10 is a plan view illustrating a schematic configuration of the upper conveying unit and the lower conveying unit of FIG. 9.
Figure 11:
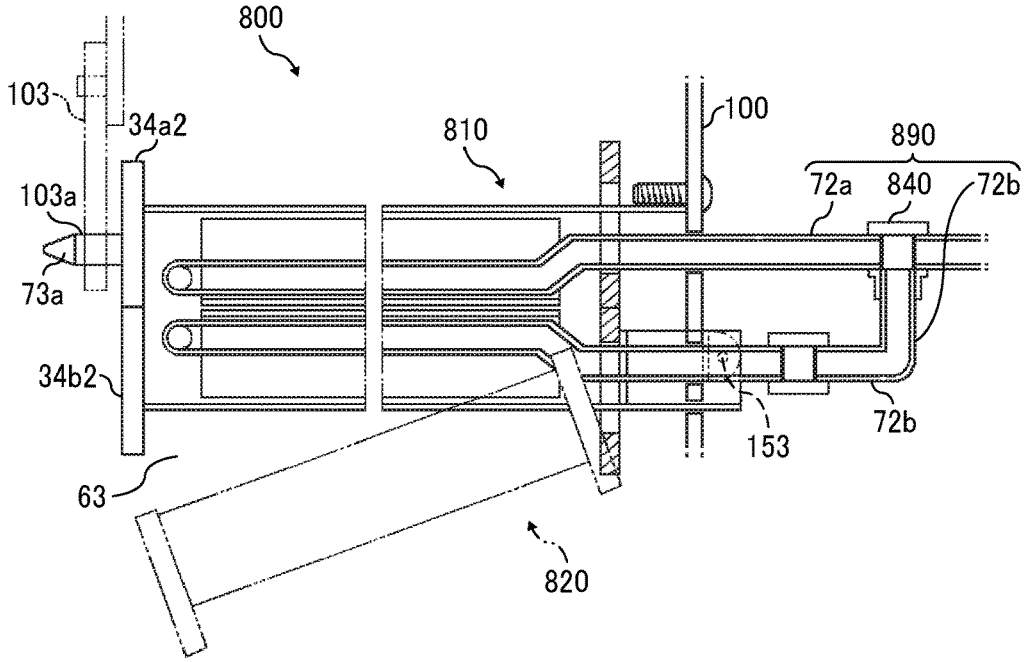
FIG. 11 is a front view illustrating transition of a lower side conveying belt to approach or separate from an upper side conveying belt.
Figure 12:
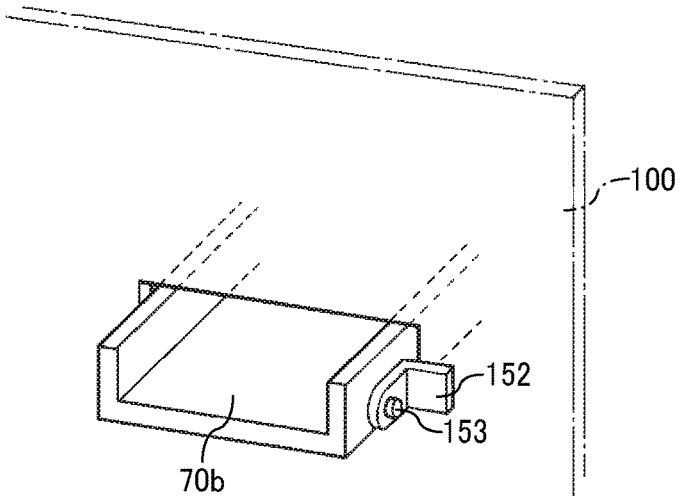
FIG. 12 is a perspective view illustrating a schematic configuration of the rear side of the cooling device of FIG. 11.

FIG. 4 is a perspective view illustrating a schematic configuration of the cooling device 800. FIG. 5A is a perspective view illustrating a schematic configuration of the upper side conveying unit 810 and the lower side conveying unit 820. FIG. 5B is an enlarged plan view illustrating a bracket 151 of the upper side conveying unit 810 and the lower side conveying unit 820 of FIG. 5A. FIG. 6 is a perspective view illustrating a schematic configuration of a support 53 supporting a lower side front plate 34*b*2. FIG. 7 is an enlarged view illustrating a schematic configuration of the support 53 supporting the lower side front plate 34*b*2. FIG. 8 is an enlarged view illustrating a schematic configuration of a recess of the lower side front plate 34*b*2, which is engaged with the support 53 illustrated in FIG. 7. FIG. 9 is a cross sectional view illustrating the upper side conveying unit 810 and the lower conveyance unit 820. FIG. 10 is a plan view illustrating a schematic configuration of the upper side conveying unit 810 and the lower conveyance unit 820 of FIG. 9. FIG. 11 is a front view illustrating transition of the lower side conveying belt 31 to approach or separate from the upper side conveying belt 2. FIG. 12 is a perspective view illustrating a schematic configuration of the rear side of the cooling device 800 of FIG. 11. It is to be noted that some of the drawings are illustrated in part to facilitate easy understanding of the inside of the configuration of the cooling device 800.

An upper side front plate 34*a*2 is disposed on a front side of the upper side conveying unit 810 of the cooling device 800. An upper side front plate 34*a*2 is disposed on a rear side of the upper side conveying unit 810 of the cooling device 800. Both the upper side front plate 34*a*2 and the upper side rear plate 34*a*1 support roller shafts (i.e., the driven roller 7 and the drive roller 3) that drives or supports the upper side conveying belt 2.

A lower side front plate 34*b*2 is disposed on a front side of the lower side conveying unit 820 of the cooling device 800. A lower side rear plate 34*b*1 is disposed on a rear side of the lower side conveying unit 820 of the cooling device 800. Both the lower side front plate 34*b*2 and the lower side rear plate 34*b*1 support roller shafts (i.e., the drive roller 32 and the drive roller 32 that drives or supports the lower side conveying belt 31.

As illustrated in FIGS. 2 and 4, the upper side conveying unit 810 of the cooling device 800 includes the drive roller 3, a drive motor 22, and the driving force transmission gear 11 at a downstream side in the sheet conveying direction. The drive roller 3 functions as a first tension body to stretch the upper side conveying belt 2 with tension. The drive motor 22 functions as a drive unit to drive the drive roller 3. The driving force transmission gear 11 functions as a first drive gear mounted on the drive roller 3. The lower side conveying unit 820 of the cooling device 800 includes the drive roller 32 and the drive gear 43. The drive roller 32 functions as a second tension body to stretch the lower side conveying belt 31 with tension. The drive gear 43 functions as a second drive gear mounted on the drive roller 32.

As illustrated in FIG. 4, the apparatus side drive gear 59 is located on the rear side of the upper side conveying unit 810. The apparatus side drive gear 59 is coupled with the drive motor 22. A drive gear 10 is coaxially mounted on the drive roller 3 and is meshed with the apparatus side drive gear 59, so as to transmit a rotation force of the apparatus side drive gear 59 to the drive roller 3. The driving force transmission gear 11 is located on the front side of the upper side conveying unit 810 and is engaged with the drive gear 43, so as to transmit a rotation driving force of the drive roller 3 to a belt driving shaft (i.e., the drive roller 32) of the lower side conveying unit 820.

Now, a detailed description is given of the upper side conveying unit 810 that functions as a first conveyor.

As illustrated in FIG. 4, the upper side conveying unit 810 includes an apparatus rear side plate 100 that has an apparatus side guide 102 that extends from the rear side of the cooling device 800 toward the front side. The apparatus side guide 102 supports an L-shaped engaging portion 9*a* that extends and protrudes upwardly from the upper side rear plate 34*a*1 and guides the engaging portion 9*a* in a front-back direction. According to this configuration, the operability in attachment and detachment of the upper side conveying unit 810 relative to the apparatus body of the image forming apparatus 600 can be enhanced.

As illustrated in FIG. 4, the driven roller 7 of the upper side conveying unit 810 is provided in the front-back direction of the cooling device 800. The driven roller 7 is supported by an upper side tension roller support body 35*a* via a bearing 36*a*. The bearing 36*a* is disposed movable in a groove formed in the upper side tension roller support body 35*a*. An elastic member 37*a* (e.g., a spring) is disposed in the groove of the upper side tension roller support body 35*a*. With the elastic member 37*a*, the driven roller 7 presses the upper side conveying belt 2 outwardly from the inside of the upper side conveying belt 2. Accordingly, the driven roller 7 in contact with the upper side conveying belt 2 is pressed against the upper side conveying belt 2, and therefore the upper side conveying belt 2 is tensioned. This application of the tension force to the upper side conveying belt 2 causes the upper side conveying belt 2 to press the drive roller 3, thereby generating a frictional force. Accordingly, the rotation force of the drive roller 3 is transmitted to the upper side conveying belt 2, so as to rotate the upper side conveying belt 2.

A connecting shaft 39*a* is partly illustrated in FIG. 4. As illustrated in FIG. 10, the connecting shaft 39*a* connects two upper side tension roller support bodies 35*a* disposed facing each other in the front-back direction in the cooling device 800. The two upper side tension roller support bodies 35*a* are rotatable about the connecting shaft 39*a*.

In the present embodiment, as illustrated in FIGS. 4 and 10, the upper side front plate 34*a*2 has a recess in a side face that faces one of the two upper side tension roller support bodies 35*a* and the upper side rear plate 34*a*1 has a recess in a side face that faces the other of the two upper side tension roller support bodies 35*a*. Both of the two upper side tension roller support bodies 35*a* have projections on respective side faces that face the respective side faces of the upper side front plate 34*a*2 and the upper side rear plate 34*a*1. In the state illustrated in FIG. 4, this engagement of the recesses of the upper side front plate 34*a*2 and the upper side rear plate 34*a*1 and the projections of the two upper side tension roller support bodies 35*a* regulates rotations of the two upper side tension roller support bodies 35*a*.

As illustrated in FIGS. 4 and 5, the upper side conveying unit 810 of the cooling device 800 includes reference pins 73*a* that are fixed to a lateral side face of a stay 70*a*. These reference pins 73*a* go through the upper side front plate 34*a*2 to be inserted into and engaged with corresponding reference holes 103*a* of the apparatus front side plate 103, as illustrated in FIG. 10. Further, engagement holes 76 of the upper side rear plate 34*a*1 are formed on the rear side of the upper side conveying unit 810. The engagement holes 76 have respective reference pins 77. The reference pins 77 are engaged with respective engagement holes 101 of the apparatus rear side plate 100. According to the above-described configuration, the apparatus body of the image forming apparatus 600 and the upper side conveying unit 810 are positioned, as illustrated in FIG. 10.

As illustrated in FIGS. 9 and 10, the first cooling plate 71*a* presses the upper side conveying belt 2 downwardly as an elastic member 98*a* that is a compression spring applies a biasing force to the first cooling plate 71*a*. One end of the elastic member 98*a* is fixed to the stay 70*a* and an opposed end of the elastic member 98*a* presses an upper face of the first cooling plate 71*a* downwardly at a position between the radiation fins 74*a* disposed adjacent to each other, as illustrated in FIG. 9. Multiple elastic members 98*a* are aligned in a direction that intersects with the sheet conveying direction of the recording medium S, as illustrated in FIG. 10. Further, the first cooling plate 71*a* and the stay 70*a* have respective guide portions at the lateral side faces. In the present embodiment, the guise portions of the first cooling plate 71*a* extend upwardly and the guide portions of the stay 70*a* extend downwardly. The first cooling plate 71*a* is movable in a vertical direction relative to the stay 70*a*.

Now, a detailed description is given of the lower side conveying unit 820 that functions as a second conveyor.

As illustrated in FIG. 4, the driven roller 33 of the lower side conveying unit 820 is provided in the front-back direction of the cooling device 800. The driven roller 33 is supported by a lower side tension roller support body 35*b* via a bearing 36*b*. The bearing 36*b* is disposed movable in a groove formed in the lower side tension roller support body 35*b*. An elastic member 37*b* (e.g., a spring) is disposed in the groove of the lower side tension roller support body 35*b*. With the elastic member 37*b*, the driven roller 33 presses the lower side conveying belt 31 outwardly from the inside of the lower side conveying belt 31. Accordingly, the driven roller 33 in contact with the lower side conveying belt 31 is pressed against the lower side conveying belt 31, and therefore the lower side conveying belt 31 is tensioned. This application of the tension force to the lower side conveying belt 31 causes the lower side conveying belt 31 to press the drive roller 32, thereby generating a frictional force. Accordingly, the rotation force of the drive roller 32 is transmitted to the lower side conveying belt 31, so as to rotate the lower side conveying belt 31.

A connecting shaft 39*b* is partly illustrated in FIG. 4. As illustrated in FIG. 10, the connecting shaft 39*b* connects two lower side tension roller support bodies 35*b* disposed facing each other in the front-back direction in the cooling device 800. The two lower side tension roller support bodies 35*b* are rotatable about the connecting shaft 39*b*. In the present embodiment, as illustrated in FIGS. 4 and 10, the lower side front plate 34*b*2 has a recess in a side face that faces one of the two lower side tension roller support bodies 35*b* and the lower side rear plate 34*b*1 has a recess in a side face that faces the other of the two lower side tension roller support bodies 35*b*. Both of the two lower side tension roller support bodies 35*b* have projections on respective side faces that face the respective side faces of the lower side front plate 34*b*2 and the lower side rear plate 34*b*1. In the state illustrated in FIG. 4, this engagement of the recesses of the lower side front plate 34*b*2 and the lower side rear plate 34*b*1 and the projections of the two lower side tension roller support bodies 35*b* regulates rotations of the two lower side tension roller support bodies 35*b*.

As illustrated in FIGS. 4, 5A and 5B, the lower side conveying unit 820 of the cooling device 800 includes reference pins 73*b* that are fixed to a lateral side face of a stay 70*b*. These reference pins 73*b* go through the lower side front plate 34*b*2 to be inserted into and engaged with the apparatus front side plate 103, as illustrated in FIG. 10. According to this configuration, a position of the front side of the second cooling plate 71*b* is determined.

As illustrated in FIGS. 5A and 5B, brackets 151 and 152 are disposed at positions behind the reference pins 73*b* disposed on the lateral side face of the stay 70*b*. The bracket 151 is an L-shaped member. One end of the bracket 151 is screwed or fixed with screw to a side face of the stay 70*b*. An opposed end of the bracket 151 has a reference hole through which a pin 155 (see FIG. 5B) that is fixed to the lower side rear plate 34*b*1 is inserted. Another bracket 151 is also disposed on the left side of the lower side conveying unit 820. With this configuration, the lower side rear plate 34*b*1 is held by the stay 70*b* and is detachably attachable via the reference pins 73*b* and the bracket 151.

The bracket 152 is an L-shaped member, as illustrated in FIG. 12. One end of the bracket 152 is screwed or fixed with screw to a rear side of the apparatus rear side plate 100 and an opposed end of the bracket 152 is rotatably supported by the lateral side face of the stay 70*b*. At this time, the bracket 152 is fixed such that the stay 70*b* can rotate about a rotary shaft 153. As illustrated in FIG. 5A, the bracket 152 includes two brackets 152. The brackets 152 are disposed at both lateral side faces of the stay 70*b* positions behind the reference pins 73*b* disposed on the lateral side face of the stay 70*b* and located outside the second cooling tube 72*b*. As described above, the lower side front plate 34*b*2, the lower side rear plate 34*b*1, and the lower side conveying belt 31 are provided as a single unit, which is the lower side conveying unit 820. As illustrated in FIG. 11, the lower side conveying unit 820 rotates about the rotary shaft 153 that functions as a rotary body, so that the lower conveying unit 820 can contact to or separate from the upper conveying unit 810.

As illustrated in FIGS. 9 and 10, the second cooling plate 71*b* presses the lower side conveying belt 31 upwardly as an elastic member 98*b* that is a compression spring applies a biasing force to the second cooling plate 71*b*. One end of the elastic member 98*b* is fixed to the stay 70*b* and an opposed end of the elastic member 98*b* presses a lower face of the second cooling plate 71*b* upwardly at a position between the radiation fins 74*b* disposed adjacent to each other, as illustrated in FIG. 9. Multiple elastic members 98*b* are aligned in a direction that intersects with the sheet conveying direction of the recording medium S, as illustrated in FIG. 10.

Further, the second cooling plate 71*b* and the stay 70*b* have respective guide portions at the lateral side faces. In the present embodiment, the guise portions of the second cooling plate 71*b* extend downwardly and the guide portions of the stay 70*b* extend upwardly. The second cooling plate 71*b* is movable in the vertical direction relative to the stay 70*b*.

For example, a comparative cooling device includes cooling members disposed facing each other and having respective cooling members including multiple cooling medium flowing passages through which a cooling medium passes by flowing in the cooling medium flowing passages alternately. Specifically, the cooling medium enters one of the multiple cooling medium flowing passages of one cooling member, passes therethrough, and exits therefrom to enter a different passage of the multiple cooling medium flowing passages of the other cooling member.

However, the temperature of the cooling medium becomes different in the cooling medium flowing passages while passing through these passages disposed adjacent to each other. In a case in which the cooling medium flowing passages are formed so as to extend in a meander shape in the cooling members, a difference of the temperatures of adjacent portions of a meandering cooling medium flowing passage in the cooling member becomes greater than the difference of temperatures of the cooling medium flowing passage of the known cooling device. Further, in the comparative cooling device, the cooling medium first flows in the meandering flowing passage of one cooling member facing one of the front side and the back side of a recording medium, and then enters the meandering flowing passage of the other cooling member facing the other of the front side and the back side of the recording medium. Therefore, a difference in temperatures of the one cooling member and the other cooling member increases. Accordingly, in a cooling device having such a configuration, the cooling medium cannot be cooled efficiently.

By contrast, as illustrated in FIGS. 2, 4, 5A, and 5B, the cooling device 800 according to an embodiment of this disclosure includes the upper side conveying belt 2, the lower side conveying belt 31, the first cooling plate 71*a*, the second cooling plate 71*b*, and the radiator 80. The upper side conveying belt 2 functions as a first conveying belt disposed on one of the front side and the back side of the recording medium S. The lower side conveying belt 31 functions as a second conveying belt disposed on the other of the front side and back side of the recording medium S. The first cooling plate 71*a* functions as a first cooling member disposed in contact with the inner circumference of the upper side conveying belt 2 to cool the recording medium S. The second cooling plate 71*b* functions as a second cooling member disposed in contact with the inner circumference of the lower side conveying belt 31 to cool the recording medium S. The radiator 80 functions as a heat dissipating part to dissipate heat of the cooling medium such as cooling liquid discharged from the first cooling plate 71*a* and the second cooling plate 71*b*. As described above, the first cooling plate 71*a* includes the first liquid inlet 78*a*, the first liquid outlet 79*a*, and the first liquid flowing passage. The first liquid inlet 78*a* is a portion through which the cooling medium flows into the inside of the cooling device 800, which is a downstream side portion of the first cooling tube 72*a* in the sheet conveying direction. The first liquid outlet

79*a* is a portion through which the cooling medium flows out to the outside of the cooling device 800, which is an upstream side portion of the first cooling tube 72*a* in the sheet conveying direction. The first liquid flowing passage extends from the first liquid inlet 78*a* to the first liquid outlet 79*a*, which includes the first cooling tube 72*a* inside the first cooling plate 71*a*. Further, as described above, the second cooling plate 71*b* includes the second liquid inlet 78*b*, the second liquid outlet 79*b*, and the second liquid flowing passage. The second liquid inlet 78*b* is a portion through which the cooling medium flows into the inside of the cooling device 800, which is a downstream side portion of the second cooling tube 72*b* in the sheet conveying direction. The second liquid outlet 79*b* is a portion through which the cooling medium flows out to the outside of the cooling device 800, which is an upstream side portion of the second cooling tube 72*b* in the sheet conveying direction. The second liquid flowing passage extends from the second liquid inlet 78*b* to the second liquid outlet 79*b*, which includes the second cooling tube 72*b* inside the second cooling plate 71*b*. The cooling device 800 further includes the cooling medium entering passage 890 and the cooling medium exiting passage 880. After heat of the cooling medium has been dissipated in the radiator 80, the cooling medium entering passage 890 causes the cooling medium to enter the first liquid inlet 78*a* and the second liquid inlet 78*b*. After the cooling medium is discharged from the first liquid outlet 79*a* and the second liquid outlet 79*b*, the cooling medium exiting passage 880 causes the cooling medium to be merged and conveyed to the radiator 80. Accordingly, a different between the temperature of one cooling plate cooling one side of a recording medium and the temperature of another cooling plate disposed facing the one cooling plate and cooling the other side of the recording medium is reduced when compared with a comparative configuration. Accordingly, the cooling effect with respect to the recording medium S can be further enhanced.

As illustrated in FIGS. 2 and 11, for example, the cooling device 800 includes the upper side conveying unit 810, the lower side conveying unit 820, and the rotary shaft 153. The upper side conveying unit 810 includes at least the upper side conveying belt 2 and the first cooling plate 71*a*. The lower side conveying unit 820 includes at least the lower side conveying belt 31 and the second cooling plate 71*b*. The rotary shaft 153 functions as a rotary body to rotate the lower side conveying unit 820 to approach and separate from the upper side conveying unit 810. The rotary shaft 153 is disposed on the side near the second cooling plate 71*b* from the second cooling plate 71*b* that functions as a reference plate. Accordingly, the recording medium can be removed from where the recording medium is left between the cooling members (e.g., the first cooling plate 71*a* and the second cooling plate 71*b*) disposed facing each other.

Further, as illustrated in FIG. 2, the first liquid inlet 78*a* and the second liquid inlet 78*b* are disposed facing each other across the sheet conveying passage A. According to this configuration, the first liquid inlet 78*a* and the second liquid inlet 78*b* (forming the cooling medium entering passage 890) through which the cooling medium enters the cooling plates are arranged facing each other, the further cooling effect can be enhanced.

Further, as illustrated in FIGS. 5A, 5B, and 11, the cooling medium entering passage 890 includes a first entering passage, a second entering passage, a flowing passage branching portion 840. The first entering passage that corresponds to the first cooling tube 72*a* is continuous to the first liquid flowing passage that corresponds to a part of the first cooling tube 72*a* extending through the inside of the first cooling plate 71*a*. The second entering passage that corresponds to the second cooling tube 72*b* is continuous to the second liquid flowing passage that corresponds to a part of the second cooling tube 72*b* extending through the inside of the second cooling plate 71*b*. The flowing passage branching portion 840 branches the liquid flowing passage into the first entering passage (i.e., the first cooling tube 72*a*) and the second entering passage (i.e., the second cooling tube 72*b*). The second entering passage (i.e., the second cooling tube 72*b*) includes an elastic member. According to this configuration, when the lower side conveying unit 820 is separated from the upper side conveying unit 810, the second entering passage (the second cooling tube 72*b*) can elastically bent, and therefore the cooling medium can be prevented from being leaked from the cooling medium entering passage 890.

When the upper side conveying belt 2 and the lower side conveying belt 31 are disposed in contact with each other, as illustrated in FIGS. 2, 9, and 11, the lower side conveying unit 820 is supported by supports 53*a* and 53*b* as illustrated in FIG. 6. As illustrated in FIGS. 6 and 7, two supports 53*a* are disposed on the right side of the lower side front plate 34*b*2 and two supports 53*b* are disposed on the left side of the lower side front plate 34*b*2. The supports 53*a* include a pressing roller 57*a*, a pressing roller shaft 55*a*, a bearing 56*a*, and a pressing member 54*a*. Similarly, the supports 53*b* include a pressing roller 57*b*, a pressing roller shaft 55*b*, a bearing 56*b*, and a pressing member 54*b*. Both the bearings 56*a* and 56*b* are mounted on the pressing roller shafts 55*a* and 55*b*, respectively, and are movable in respective guide grooves 61 of the supports 53*a* and 53*b*.

FIG. 7 is an enlarged view illustrating a schematic configuration of either one of the supports 53*a* and 53*b* supporting the lower side front plate 34*b*2.

As illustrated in FIGS. 6 and 8, an outer circumferential surface of the cylindrical pressing roller 57 (i.e., the pressing rollers 57*a* and 57*b*) is engaged with lower side faces 34*a* and 34*b* of the lower side front plate 34*b*2 that is formed in a chevron-shaped cut 62. With this configuration, the pressing roller 57 transmits a pressing force exerted by the pressing member 54 (i.e., the pressing members 54*a* and 54*b*) including a compression spring from the lower side front plate 34*b*2 to the lower side conveying unit 820 via the pressing roller shaft 55 (i.e., the pressing roller shafts 55*a* and 55*b*) and the bearing 56 (i.e., the bearings 56*a* and 56*b*). That is, the pressing roller 57 presses the lower side conveying unit 820 against the upper side conveying unit 810.

As illustrated in FIG. 8, the lower side faces 34*a* and 34*b* of the lower side front plate 34*b*2 are respective inclined surfaces that are inclined relative to a horizontal plane. The lower side faces 34*a* and 34*b* contact two points on the outer circumferential surface of the pressing roller 57. These contact positions are located upper than the center of rotation of the pressing roller 57.

As illustrated in FIGS. 6 and 7, each of the supports 53*a* and 53*b* has a U-shaped cross section. The support 53*a* holds the pressing roller 57*a*, the bearing 56*a*, the pressing roller shaft 55*a*, and the pressing member 54*a*. Similarly, the support 53*b* holds the pressing roller 57*b*, the bearing 56*b*, the pressing roller shaft 55*b*, and the pressing member 54*b*. Further, the supports 53*a* and 53*b* are rotatably disposed to the brackets 51*a* and 51*b*, respectively, via respective shafts 52*a* and 52*b*. By contrast, the brackets 51*a* and 51*b* are fixed to an apparatus frame 60 of the apparatus body of the image forming apparatus 600, as illustrated in FIG. 6.

As illustrated in FIG. 6, a handle 58 is fixedly mounted on the shaft 52*a*. As the handle 58 is rotated in the counterclockwise direction, the shaft 52*a* is also rotated in the counterclockwise direction. Together with the rotation of the shaft 52*a*, the supports 53*a* and 53*b* are rotated in the counterclockwise direction. The rotations of the supports 53*a* and 53*b* release the engagement of the pressing rollers 57*a* and 57*b* and the lower side faces 34*a* and 34*b* of the lower side front plate 34*b*2. Consequently, as illustrated by a dashed line in FIG. 11, the lower side conveying unit 820 rotates about the center of rotation of the rotary shaft 153, and therefore a space 63 is provided between the lower side conveying unit 820 and the upper side conveying unit 810 on the left side (that is, on the front side of the image forming apparatus 600) in the drawing. Accordingly, in a case in which the image forming apparatus 600 is stopped while the recording medium S is being held between the upper side conveying belt 2 and the lower side conveying belt 31, as a user rotates the handle 58 in the counterclockwise direction, the lower side conveying unit 820 is rotated downwardly. By so doing, the space 63 illustrated in FIG. 11 is formed, so that the recording medium S can be removed from the image forming apparatus 600 via the space 63.

In the state of the cooling device 800 illustrated in FIG. 11, the upper side conveying unit 810 and the lower side conveying unit 820 do not move from the apparatus body of the image forming apparatus 600. Therefore, when compared with a comparative configuration in which the upper side conveying unit 810 is removed from the apparatus body, the cooling device 800 according to the present embodiment of this disclosure can have a simpler configuration.

Figure 13A:
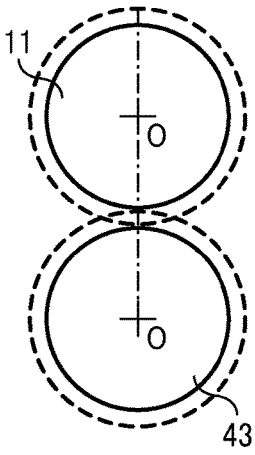
FIG. 13A through FIG. 13C are diagrams illustrating positional relations of a drive transmission gear and a drive gear while the upper conveying belt and the lower conveying belt are holding the recording medium.
Figure 13B:
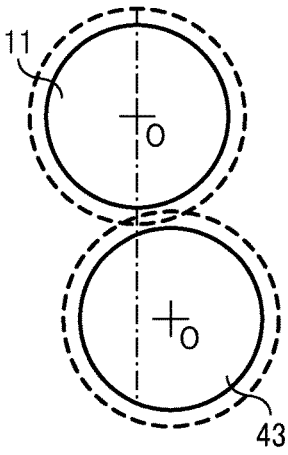
Figure 13C:
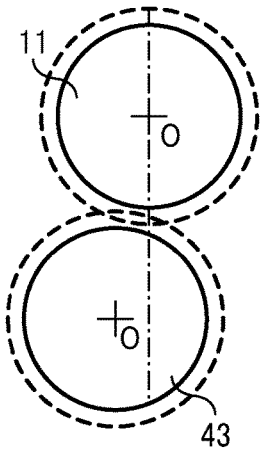

FIG. 13A through FIG. 13C are diagrams illustrating positional relations of the drive transmission gear 11 and the drive gear 43 while the upper conveying belt 2 and the lower conveying belt 31 are holding the recording medium S.

In FIG. 13A through FIG. 13C, respective dashed lines provided around an outer circumferences of the driving force transmission gear 11 and an outer circumference of the drive gear 43 indicate respective tip positions of the driving force transmission gear 11 and the drive gear 43.

In a case in which a center O of the drive gear 43 is shifted upstream from a vertical line passing a center O of the driving force transmission gear 11 in the sheet conveying direction (as illustrated in FIG. 13B) or downstream from the vertical line in the sheet conveying direction (as illustrated in FIG. 13C), when the lower side conveying unit 820 is rotated to a closed position, the tip of the driving force transmission gear 11 and the tip of the drive gear 43 are meshed with each other, without facing and contacting each other. More specifically, when the upper side conveying belt 2 remains stopped, the driving force transmission gear 11 is also stopped. Therefore, when the drive gear 43 that can be rotated approaches the driving force transmission gear 11 and contacts the tip of the driving force transmission gear 11, the drive gear 43 meshes with the driving force transmission gear 11 while rotating.

By contrast, as the lower side conveying belt 31 separates from the upper side conveying belt 2 due to rotation of the lower side conveying unit 820 about the rotary shaft 153, the engagement of the driving force transmission gear 11 and the drive gear 43 is released. Accordingly, the drive coupling of the upper side conveying unit 810 and the lower side conveying unit 820 is released, and therefore the performance of removal of the recording medium S from the upper side conveying unit 810 and the lower side conveying unit 820 can be enhanced.

By contrast, in a case in which the center O of the drive gear 43 and the center O of the driving force transmission gear 11 are on the vertical line (as illustrated in FIG. 13A), when the drive gear 43 reaches a holding position of the recording medium S between the upper side conveying belt 2 and the lower side conveying belt 31, the drive gear 43 is lifted upwardly in the vertical direction. Accordingly, it is likely that the tip of the driving force transmission gear 11 and the tip of the drive gear 43 faces each other, and therefore the teeth of the driving force transmission gear 11 and the teeth of the drive gear 43 do not mesh with each other. Accordingly, it is preferable that the center O of the drive gear 43 is shifted from the vertical line passing the center O of the driving force transmission gear 11 in the sheet conveying direction.

Figure 14A:
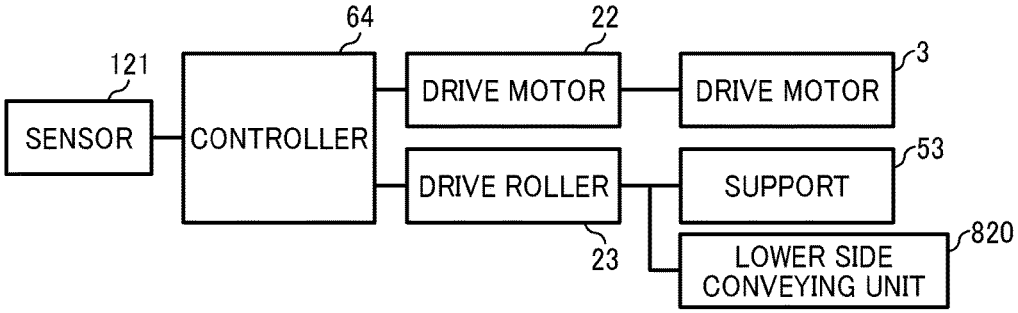
FIG. 14A is a block diagram illustrating a controller that controls the drive of the support.
Figure 14B:
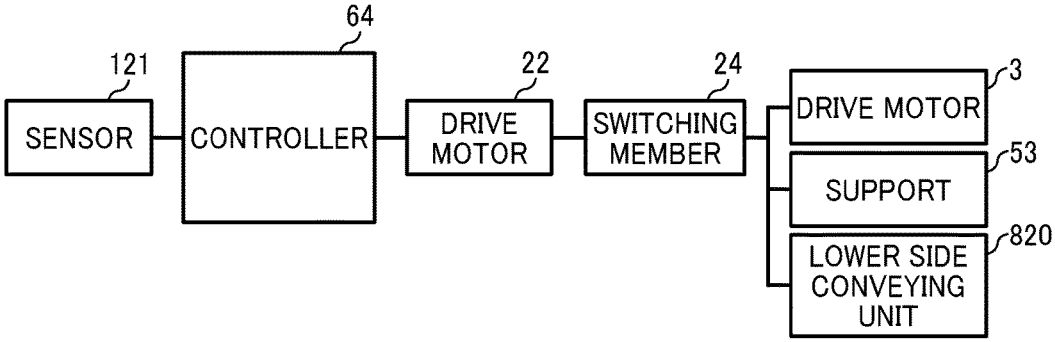
FIG. 14B is a block diagram illustrating the controller that controls of driving of the support.

FIG. 14A is a block diagram illustrating a controller that controls the drive of the support 53 (i.e., the supports 53*a* and 53*b*). FIG. 14B is a block diagram illustrating the controller that controls of driving of a support having a different configuration from the support of FIG. 14A.

In the cooling device 800 having the above-described configuration, the support 53 (i.e., the supports 53*a* and 53*b*) is moved by a user rotating the handle 58 manually. However, the cooling device 800 according to the present embodiment includes a drive motor 23 to drive the support 53.

As illustrated in FIG. 14A, the cooling device 800 includes the drive motor 22 to drive the drive roller 3 and further includes a drive motor 23 to drive the support 53. In a case in which the image forming apparatus 600 is stopped, when a sensor 121 detects that a cover of the image forming apparatus 600 is opened, the drive motor 23 receives an instruction issued by a controller 64 that is connected to the sensor 121, so that the support 53 is rotated. With the rotation of the support 53, the lower side conveying unit 820 is moved to a lower position. Further, the drive motor 23 may drive to rotate the lower side conveying unit 820. By rotating the support 53 automatically by the drive motor 23, the manual operation performed by a user can be omitted, and therefore a period of time for maintenance while the image forming apparatus 600 is stopped can be reduced.

Further, the sensor 121 may detect paper jam in the sheet conveying passage A of the image forming apparatus 600.

As illustrated in FIG. 14A, the cooling device 800 does not include the drive motor 23 to drive and rotate the support 53 and causes the drive motor 22 provided for the drive roller 3 to drive both the support 53 and the lower side conveying unit 820. Therefore, a switching member 24 is further included in the cooling device 800.

The switching member 24 switches the operation of the drive motor 22 to transmit a driving force to the drive roller 3 while the image forming apparatus 600 is operating. By contrast, the switching member 24 switches the operation of the drive motor 22 to transmit a driving force to the support 53 and the lower side conveying unit 820. Accordingly, the cooling device 800 according to the present embodiment can reduce in size, when compared with the configuration illustrated in FIG. 14A.

It is to be noted that, in FIG. 14, when the image forming apparatus 600 stops the image forming operations, the sensor 121 may detect whether or not the recording medium S is in the cooling device 800. In this case, the drive motor 22 or the drive motor 23 causes the lower side conveying unit 820 to automatically separate from the upper side conveying unit 810, so that the upper side conveying belt 2 and the lower side conveying belt 31 can be separated from each other quickly, thereby preventing toner adhesion to the upper side conveying belt 2 and the lower side conveying belt 31.

Figure 15:
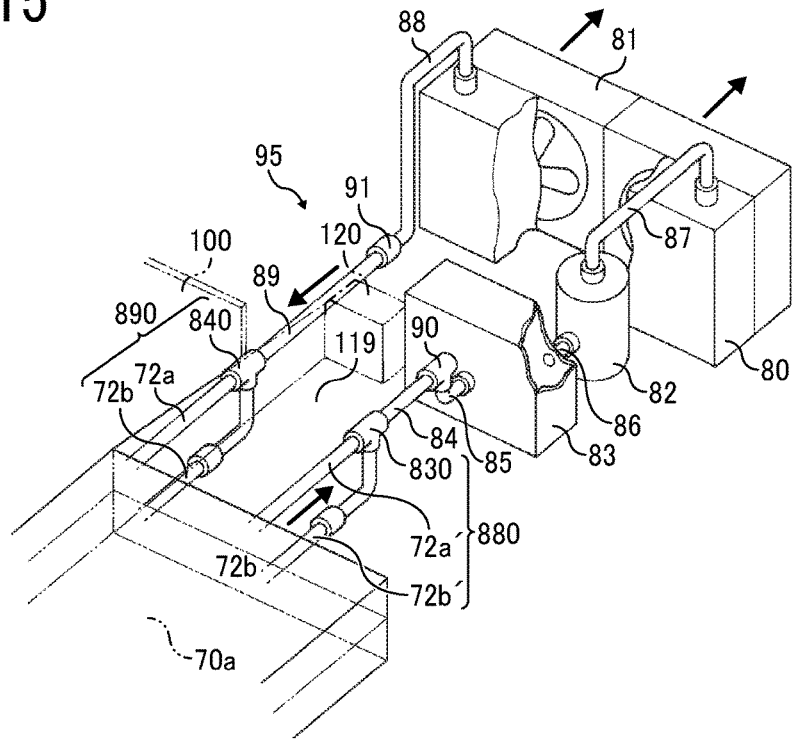
FIG. 15 is a perspective view illustrating a schematic configuration of a radiator.

FIG. 15 is a perspective view illustrating a schematic configuration of the radiator 80.

A circulation channel 95 includes pipes 84, 85, 86, 87, 88, and 89. The pipes 84 and 85 connect one opening of the cooling plate 71 (i.e., one of the first cooling plate 71*a* and the second cooling plate 71*b*) and the liquid tank 83. The pipes 88 and 89 connect the other opening of the cooling plate 71 and the radiator 80. The pipe 87 connects the radiator 80 and the pump 82. The pipe 86 connects the pump 82 and the liquid tank 83.

A fitting 90 connects the pipes 84 and 85 and a fitting 91 connects the pipes 88 and 89. The circulation channel 95 including the pipes 84, 85, 86, 87, 88, and 89 forms a single liquid channel. However, the circulation channel 95 meanders in the cooling plate 71, as illustrated in FIG. 3, so that the cooling medium that flows in the circulation channel 95 can effectively cool the cooling plate 71. The cooling medium that is cooled by the radiator 80 is desired to be guided to the downstream side of the sheet conveying direction of the recording medium S.

The liquid tank 83 functions as a tank to contain the cooling medium that has passed through the cooling tube (i.e., one of the first cooling tube 72*a* and the second cooling tube 72*b*). The pump 82 functions as a conveying unit to convey the cooling medium. Further, the liquid tank 83 and the pump 82 are provided between the cooling plate 71 and the radiator 80. With this layout, the liquid tank 83 and the pump 82 are disposed at an upstream side of an air flowing direction of the fan 81 that cools the radiator 80, and therefore are not affected by waste heat. Accordingly, the cooling efficiency can be further enhanced.

The radiator 80 functions as a heat dissipating part from which heat of the cooling medium is dissipated. The radiator 80 has multiple flowing passages in the vertical direction to flow the cooling medium entered from the pipe 87 to the pipe 88. Fins are arranged between each of adjacent flowing passages of the radiator 80. As air passes through the fins, the cooling medium in the flowing passages of the radiator 80 is cooled.

It is to be noted that the fan 81 is located at the downstream side of the air flowing direction of the radiator 80 and rotates to intake or draw air from radiator 80. According to this configuration, the air passes inside the radiator 80.

In addition, outside air is drawn from an upper part or a lateral side part of the radiator 80 and passes out through an opposed face where the radiator 80 faces the fan 81 and an opposite face of the fan 81 to the opposed face of the radiator 80.

It is to be noted that, in FIG. 15, two fans 81 are provided to one radiator 80. However, the configuration of the radiator 80 is not limited thereto. For example, a configuration including one fan is provided to one radiator can be applied to this disclosure. In addition, the number of fans may be one, three or more.

Referring to FIGS. 4 and 15, the stay 70*a* supports the cooling plate 71 (i.e., the first cooling plate 71*a*) fixed to the apparatus body of the image forming apparatus 600. The stay 70*a* covers the first cooling plate 71*a* to form a flowing passage to flow air between the radiation fins 74*a* disposed adjacent to each other. Similarly, the stay 70*b* covers the second cooling plate 71*b* to form a flowing passage to flow air between the radiations fins 74*b* disposed adjacent to each other.

The first cooling plate 71*a* functions as a cooling plate that holds and fixes the first cooling tube 72*a*. The first cooling plate 71*a* causes the heat absorbing surface disposed opposite the radiation fin 74*a* to contact an inner circumferential surface of the upper side conveying belt 2. By so doing, the first cooling plate 71*a* cools the upper side conveying belt 2, and further absorbs heat of the recording medium S in contact with the upper side conveying belt 2. The recording medium S is thus cooled.

Similarly, the second cooling plate 71*b* functions as a cooling plate that holds and fixes the second cooling plate 71*b*. The second cooling plate 71*b* causes the heat absorbing surface disposed opposite the radiation fin 74*b* to contact an inner circumferential surface of the lower side conveying belt 31. By so doing, the second cooling plate 71*b* cools the lower side conveying belt 31, and further absorbs heat of the recording medium S in contact with the lower side conveying belt 31. The recording medium S is thus cooled.

As illustrated in FIG. 15, an opening is provided to the rear side of the stay 70*a*, a stay 70*b*, the first cooling plate 71*a*, and the second cooling plate 71*b* (the rear side of the image forming apparatus 600). A duct 119 is connected to the opening and the opening is closed.

A fan 120 is disposed at an end of the duct 119. The duct 119 and the fan 120 both guide air passing an air flowing passage defined by the radiation fins 74*a* and 74*b*, and are disposed between the first cooling plate 71*a* and second cooling plate 71*b* and the radiator 80 and adjacent to the liquid tank 83. Since the duct 119 and the fan 120 are disposed in an empty space next to the liquid tank 83, the cooling device 800 can be reduced in size. The duct 119 is disposed in a space between the pipes 84 and 89. The width of the duct 119 is tapered from the front side toward the rear side of the image forming apparatus 600, in other words, from the upstream side toward the downstream side of the air flowing direction. An inlet of the duct 119 has an opening area that can accept both the radiation fins 74*a* and 74*b*. The fan 120 rotates so as to intake air from the duct 119.

The fan 120 intakes outside air from the front face of the apparatus body of the image forming apparatus 600 or the lateral side face, which is disposed adjacent to the front face, of the apparatus body of the image forming apparatus 600. The outside air flows from a gap 118 between the upper side front plate 34*a*2 and the upper side conveying belt 2, as illustrated in FIG. 10, to a space between the radiation fins 74*a* and 74*b*. The air that has flown between the radiation fins 74*a* and 74*b* passes through the duct 119, and is discharged by the fan 120. The discharged air passes through the radiator 80, and is discharged to the outside by the fan 81.

Next, a description is given of operations of the cooling device 800 having the above-described configuration.

When the upper side conveying belt 2 and the lower side conveying belt 31 hold and convey the recording medium S in the cooling device 800, the upper side conveying unit 810 and the lower side conveying unit 820 are arranged to be close to each other, as illustrated in FIG. 2. In this state, as the drive roller 3 of the upper side conveying unit 810 is rotated, the upper side conveying belt 2 rotates in a direction indicated by R in FIG. 2 and the lower side conveying belt 31 rotates in a direction indicated by arrow L in FIG. 2. Accordingly, the recording medium S is conveyed to a direction indicated by arrow as illustrated in FIG. 2. While the upper side conveying unit 810 and the lower side conveying unit 820 convey the recording medium P, the cooling medium circulates in the circulation channel 95.

Specifically, by driving the pump 82, the cooling medium flows inside the cooling medium flowing passage of the cooling plate 71.

At this time, the inner circumferential surface of the upper side conveying belt 2 of the upper side conveying unit 810 slides on the heat absorbing surface of the first cooling plate 71*a*. With this configuration, the first cooling plate 71*a* absorbs heat of the recording medium S from the front face side of the recording medium S via the upper side conveying belt 2. In this case, the cooling medium transfers the amount of heat absorbed by the cooling plate 71, and therefore the first cooling plate 71*a* can keep the low temperature.

Similarly, the inner circumferential surface of the lower side conveying belt 31 of the lower side conveying unit 820 slides on the heat absorbing surface of the second cooling plate 71*b*. With this configuration, the second cooling plate 71*b* absorbs heat of the recording medium S from the back face side of the recording medium S via the lower side conveying belt 31. In this case, the cooling medium transfers the amount of heat absorbed by the cooling plate 71, and therefore the second cooling plate 71*b* can keep the low temperature.

Specifically, driving of the pump 82 circulates the cooling medium through the circulation channel 95. As the cooling medium heated to a certain temperature by absorbing heat while flowing in the cooling medium flowing passage of the cooling plate 71 passes through the radiator 80, the heat of the cooling medium is radiated to outside air, thus reducing the temperature of the cooling medium. Then, the cooling medium at relatively low temperature flows through the circulation channel 95 again, and the first cooling plate 71*a* and the second cooling plate 71*b* function to absorb heat from the recording medium S. Therefore, by repeating the above-described cycle, the recording medium S is cooled from both sides thereof.

Figure 16:
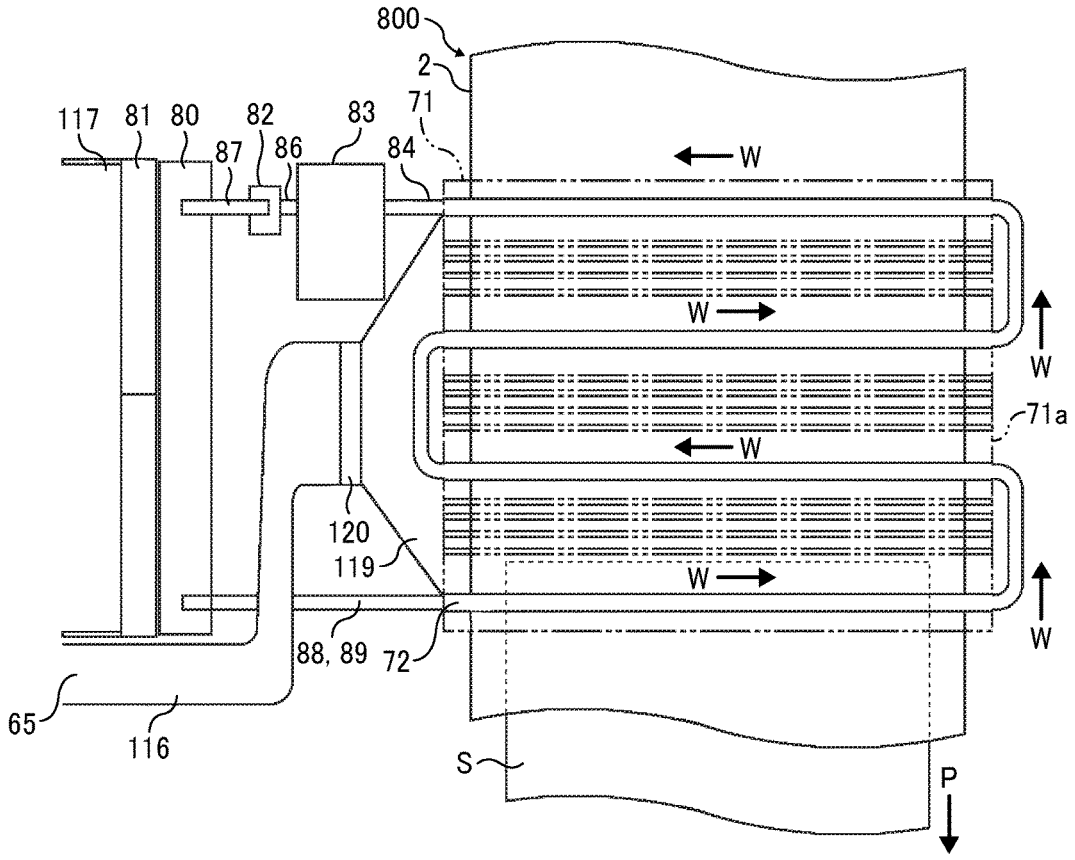
FIG. 16 is a schematic view illustrating a variation of the cooling device of FIG. 14.

FIG. 16 is a schematic plan view illustrating a variation of the cooling device 800 of FIG. 14. It is to be noted that there are four flowing passages in the sheet conveying direction in FIG. 16. However, the configuration of this variation can also be applied to the flowing passage in the configuration illustrated in FIG. 3.

When the temperature of air exhausted by the fan 120 is higher than the temperature of outside air that passes through the radiator 80, it is difficult to cool the cooling medium flowing in the radiator 80 efficiently. In order to cool the cooling medium flowing in the radiator 80 efficiently, the cooling device 800 illustrated in FIG. 15 includes a duct 116 at the trailing end of the fan 120. The duct 116 exhausts air discharged by the fan 120 to the outside of the image forming apparatus 600. Consequently, in order to intake air from the right side of the radiator 80, it is preferable to provide a gap between the duct 116 and the radiator 80. In order to form the gap, the duct 116 bends in the sheet conveying direction of the recording medium S (i.e., in the downward direction in FIG. 16) and extends from the front to the rear of the image forming apparatus 600. At that time, in order not to interfere the duct 116 with the pipes 88 and 89, the flowing passage of the duct 116 is provided above the pipes 88 and 89. After having passed through the duct 116, the air is exhausted to the outside of the image forming apparatus 600 via an air exhaust port 65.

In the present embodiment, since the air heated by passing through the radiation fins 74*a* and 74*b* do not pass the radiator 80, the cooling medium passing through the radiator 80 can be cooled efficiently.

Figure 17:
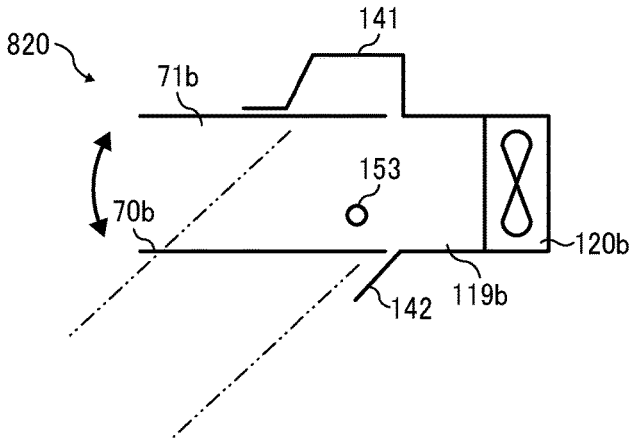
FIG. 17 is a cross sectional view of a variation of a duct of FIG. 15.

FIG. 17 is a cross sectional view of a variation of the duct 119 of FIG. 15.

The cooling device 800 illustrated in FIG. 15 includes a single duct (i.e., the duct 119) into which the air that has passed through the radiation fins 74*a* and 74*b* is guided and introduced. However, the configuration is not limited thereto. For example, the cooling device 800 may include both a duct 119*a* and a fan 120*a* for the radiation fins 74*a*, and both a duct 119*b* and a fan 120*b* for the radiation fins 74*b*, respectively.

As illustrated in FIG. 17, the cooling device 800 includes the duct 119*b* and the fan 120*b* in addition to the radiation fins 74*b* of the lower conveying unit 820 so as to function together with the radiation fins 74*b* of the lower conveying unit 820. As illustrated in FIG. 17, the lower side conveying unit 820 rotates about the rotary shaft 153. Therefore, an upper side inlet port 141 and a lower side inlet port 142 of the duct 119*b* that corresponds to the radiation fins 74*b* of the lower side conveying unit 820 is disposed not to interfere with the second cooling plate 71*b* and the stay 70*b*.

In order to avoid the interference, the upper side inlet port 141 and the lower side inlet port 142 of the duct 119 have respective shapes to deviate from respective rotation trajectories of the second cooling plate 71*b* and the stay 70*b*. Specifically, the upper side inlet port 141 has an upwardly projecting shape and the lower side inlet port 142 has a downwardly inclining shape.

Figure 18:
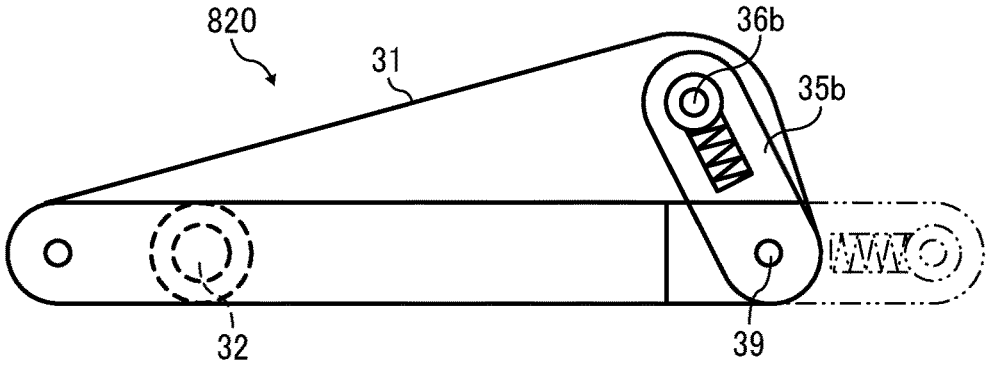
FIG. 18 is a side view illustrating how to change the conveying belt.

FIG. 18 is a side view illustrating how to change the lower side conveying belt 31. Since the upper side conveying unit 810 and the lower side conveying unit 820 have an identical configuration to each other, how to change the lower side conveying belt 31 of the lower side conveying unit 820 is explained with reference to FIG. 18.

As indicated by a dashed line in FIG. 11, after the lower side conveying unit 820 has been lowered to the lower position, the above-described conveying units (i.e., the upper side conveying unit 810 and the lower side conveying unit 820) are disengaged from each other. By so doing, the lower side conveying unit 820 can be pulled out toward a user to be removed from the image forming apparatus 600. When changing the lower side conveying belt 31, the lower side tension roller support body 35*b* is rotated about the coupling shaft 39 in the counterclockwise direction. By so doing, the driven roller 33 moves as illustrated by a solid line in FIG. 18, the tension state of the lower side conveying belt 31 is released. By releasing the tension state of the lower side conveying belt 31, an inner circumference length of the lower side conveying belt 31 is greater than an outer circumference of each of the rollers.

Figure 19:
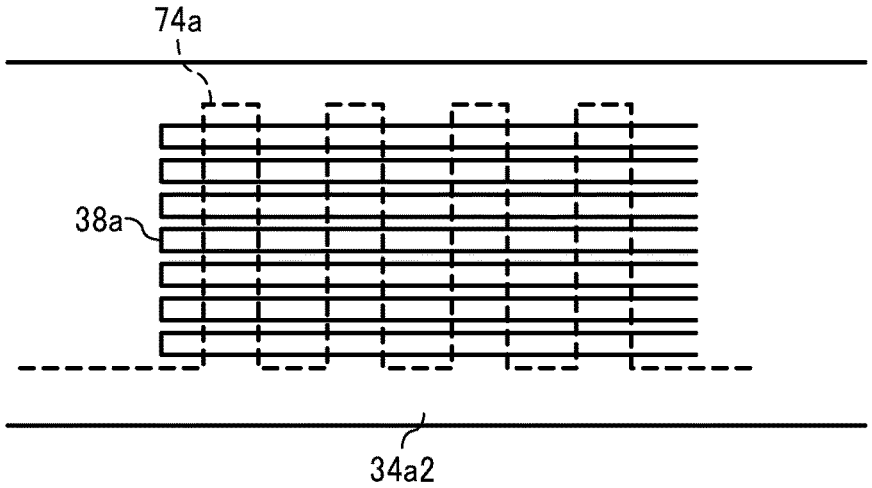
FIG. 19 is a front view illustrating a relation of an upper front side panel and a heat dissipating fin.

FIG. 19 is a front view illustrating a relation of the upper side front plate 34*a*2 and the radiation fin 74*a*. The relation of the lower side front plate 34*b*2 and the radiation fins 74*b* is the same as the relation of the upper side front plate 34*a*2 and the radiation fin 74*b*.

In the cooling device 800 illustrated in FIG. 10, the outside air is drawn from the gap 118 between the upper side front plate 34*a*2 and the upper side conveying belt 2 to the space between the radiation fins 74*a* and 74*b*. By contrast, the cooling device 800 in FIG. 19 includes multiple slits 38*a* disposed facing the radiation fin 74*a*. The multiple slits 38*a* are openings to communicate with the air flowing passage defined by the radiation fins 74*a*. The multiple slits 38*a* are formed in the vertical direction and extend in the sheet conveying direction of the recording medium S over the entire width of the multiple radiation fins 74*a* disposed between the cooling tubes 72 (i.e., the first cooling tube 72*a* and the second cooling tube 72*b*) adjacent to each other. According to this configuration, the outside air can be taken between the radiation fins 74*a* more easily, and therefore the greater amount of heat can be released from the heat absorbing surface of the cooling plate 71.

Figure 20:
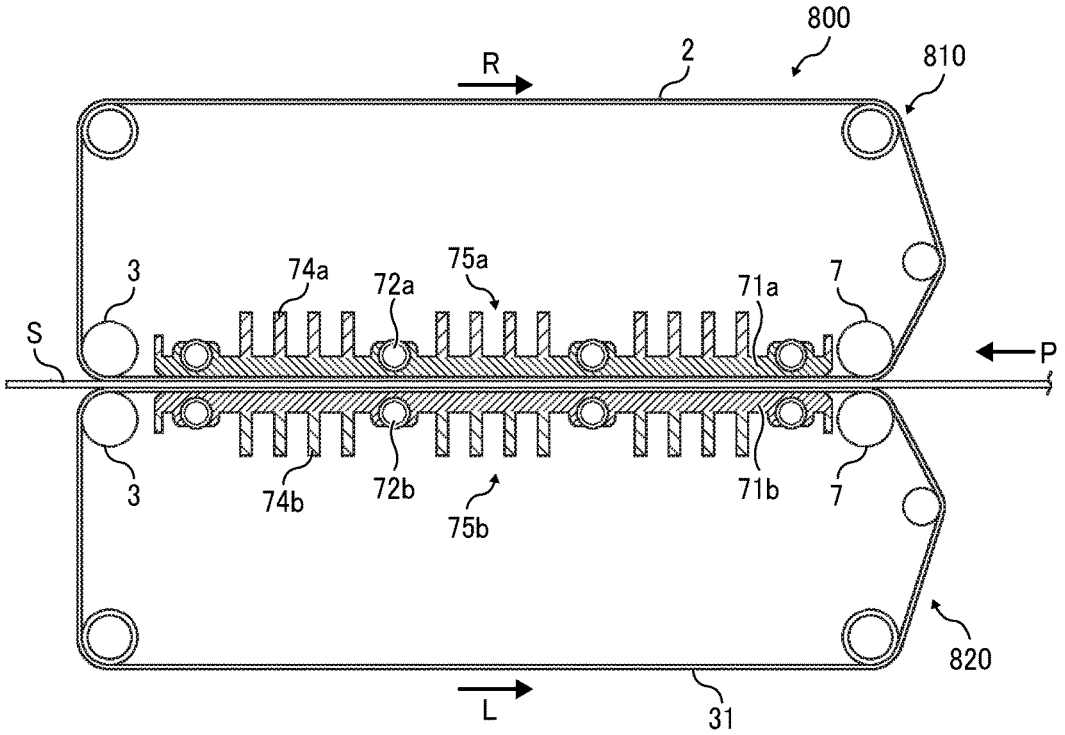
FIG. 20 is a cross sectional view of a variation of the cooling device of FIG. 2.

FIG. 20 is a cross sectional view of a variation of the cooling device 800 of FIG. 2.

Different from the cooling device illustrated in FIG. 2, the cooling device 800 according to the embodiment illustrated in FIG. 20 includes three or more cooling medium flowing passages inside each of the first cooling plate 71*a* and the second cooling plate 71*b*. According to this configuration, the cooling effect with respect to the recording medium S can be more enhanced.

Figure 21:
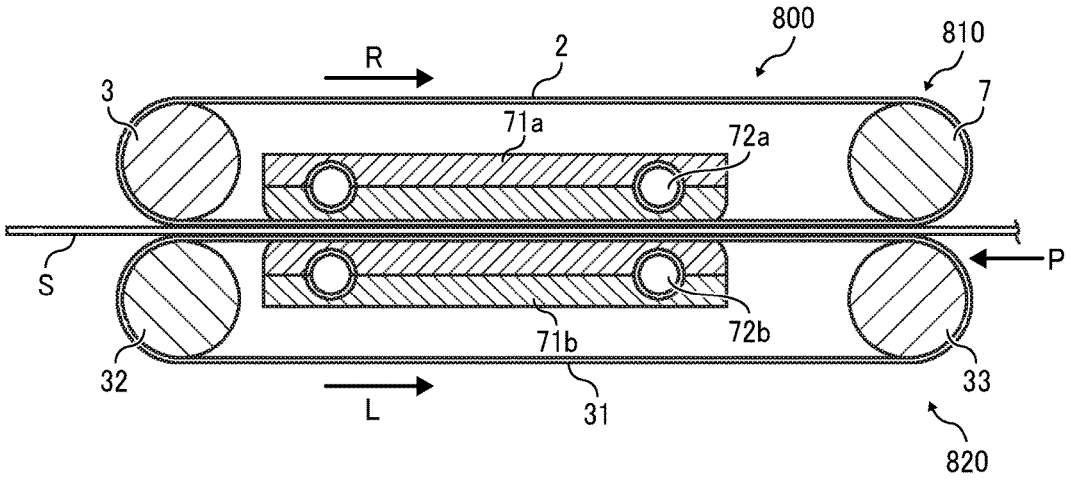
FIG. 21 is a cross sectional view of another variation of the cooling device of FIG. 2.

FIG. 21 is a cross sectional view of another variation of the cooling device 800 of FIG. 2.

Figure 22:
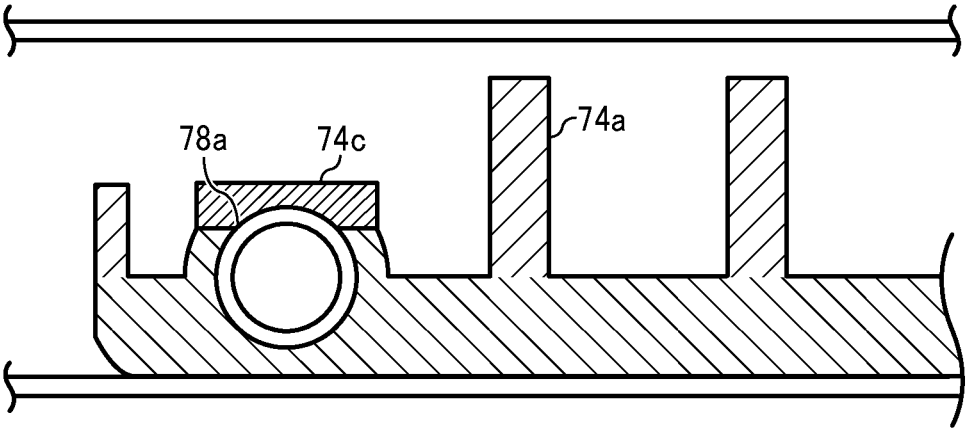
FIG. 22 is a cross sectional view of yet another variation of the cooling device of FIG. 2.

Different from the cooling device illustrated in FIG. 2, the cooling device 800 according to the embodiment illustrated in FIG. 22 includes the first cooling plate 71*a* and the second cooling plate 71*b* without any radiation fins. Each of the first cooling plate 71*a* and the second cooling plate 71*b* has a flat plate shape. Accordingly, the recording medium S can be cooled by the cooling plate 71 having a simple configuration.

It is to be noted that the cooling medium flowing passage is not limited to a cooling tube. For example, by cooling medium flowing passages 72*a* and 72*b* can be formed in the first cooling plate 71*a* and second cooling plate 71*b* by cutting. It is to be noted that a cooling medium flowing passage formed by cutting can be applied to each of the above-described embodiments.

FIG. 22 is a cross sectional view of yet another variation of the cooling device 800 of FIG. 2.

FIG. 22 illustrates an enlarged view of the first liquid inlet 78*a*. In this configuration, the first liquid inlet 78*a* having a pipe shape is engaged with the cooling unit 75*a*, and therefore the circumferential surface of an upper part of the first liquid inlet 78*a* is not covered by the cooling unit 75*a*. Therefore, the air drawn by the fan 120 passes through the circumferential surface of the upper part of the first liquid inlet 78*a*.

When the temperature of the air is higher than the temperature of the cooling medium that passes through the first liquid inlet 78*a*, it is likely that the cooling medium in the first liquid inlet 78*a* is heated. Therefore, in this variation, a heat insulating member 74*c* is provided to cover the circumferential surface of the upper part of the first liquid inlet 78*a*. With this configuration, the air does not contact the circumferential surface of the first liquid inlet 78*a* directly, heating of the cooling medium while the cooling medium is passing in the first liquid inlet 78*a* can be prevent.

It is to be noted that, even though the heat insulating member 74*c* is provided on the upper part of the first liquid inlet 78*a* in FIG. 22, the heat insulating member 74*c* may also cover the cooling unit 75*a* that covers both the left and right sides of the first liquid inlet 78*a*. Further, a heat insulating member may be provided to cover the circumferential surface of the upper side of the second liquid inlet 78*b* Therefore, in this second liquid inlet 78*b*, a is provided to cover the circumferential surface of the upper part of the second liquid inlet 78*b*.

The cooling device 800 and the image forming apparatus 600 including the cooling device 800 are described with the above-described embodiments in reference to the drawings above. However, this disclosure is not limited to the above-identified embodiments. For example, the recording medium may be a sheet type recording medium or a roll type recording medium and include an electronic printed substrate. Further, the image forming apparatus 600 is not limited to an electrophotographic image forming apparatus but may be an inkjet type image forming apparatus.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A cooling device comprising:

a first conveying belt disposed facing one side of a recording medium while the recording medium is conveyed in a sheet conveying direction;

a first cooling body including:

a first liquid inlet through which a cooling medium enters inside the first cooling body;

a first liquid outlet through which the cooling medium exits outside the first cooling body; and a first liquid flowing passage through which the cooling medium flows between the first liquid inlet and the first liquid outlet;

the first cooling body configured to contact an inner circumferential surface of the first conveying belt and cool the recording medium;

a second conveying belt disposed facing the other side of the recording medium while the recording medium is conveyed in the sheet conveying direction;

a second cooling body including:

a second liquid inlet through which the cooling medium enters inside the second cooling body;

a second liquid outlet through which the cooling medium exits outside the second cooling body; and a second liquid flowing passage through which the cooling medium flows between the second liquid inlet and the second liquid outlet;

the second cooling body configured to contact an inner circumferential surface of the second conveying belt and cool the recording medium;

a heat dissipating body configured to dissipate heat of the cooling medium discharged from the first cooling body and the second cooling body;

a cooling medium entering passage configured to flow the cooling medium dissipated by the heat dissipating body to the first liquid inlet and the second liquid inlet, respectively; and a cooling medium exiting passage configured to merge the cooling medium discharged from the first liquid outlet and the second liquid outlet and flow the merged cooling medium to the heat dissipating body;

the cooling medium exiting passage including a flowing passage gathering portion disposed downstream from the first liquid outlet and the second liquid outlet in a cooling medium flowing direction, the flowing passage gathering portion configured to merge the cooling medium discharged from the first liquid outlet and the second liquid outlet.

2. The cooling device according to claim 1, wherein the flowing passage gathering portion is disposed at a position away from the first cooling body and the second cooling body.

3. The cooling device according to claim 1, further comprising:

a first conveyor including at least the first conveying belt and the first cooling body;

a second conveyor including at least the second conveying belt and the second cooling body; and a rotary body configured to rotate the second conveyor to move the second conveyor to approach and separate from the first conveyor, wherein the rotary body is disposed closer close to the second liquid inlet than the first liquid inlet.

4. The cooling device according to claim 1, wherein the first liquid inlet and the second liquid inlet are disposed facing each other via a sheet conveying passage of the recording medium.

5. An image forming apparatus comprising:

an image forming device configured to form an image on a recording medium; and the cooling device according to claim 1.

6. A cooling device comprising:

a first conveying belt disposed facing one side of a recording medium while the recording medium is conveyed in a sheet conveying direction;

a first cooling body including:

a first liquid inlet through which a cooling medium enters inside the first cooling body;

a first liquid outlet through which the cooling medium exits outside the first cooling body; and a first liquid flowing passage through which the cooling medium flows between the first liquid inlet and the first liquid outlet;

the first cooling body configured to contact an inner circumferential surface of the first conveying belt and cool the recording medium;

a second conveying belt disposed facing the other side of the recording medium while the recording medium is conveyed in the sheet conveying direction;

a second cooling body including:

a second liquid inlet through which the cooling medium enters inside the second cooling body;

a second liquid outlet through which the cooling medium exits outside the second cooling body; and a second liquid flowing passage through which the cooling medium flows between the second liquid inlet and the second liquid outlet;

the second cooling body configured to contact an inner circumferential surface of the second conveying belt and cool the recording medium;

a heat dissipating body configured to dissipate heat of the cooling medium discharged from the first cooling body and the second cooling body;

a cooling medium entering passage configured to flow the cooling medium dissipated by the heat dissipating body to the first liquid inlet and the second liquid inlet, respectively; and a cooling medium exiting passage configured to flow the cooling medium discharged from the first liquid outlet and the second liquid outlet to the heat dissipating body, the cooling medium entering passage including a flowing passage branching portion disposed upstream from the first liquid inlet and the second liquid inlet in a cooling medium flowing direction, and the flowing passage branching portion configured to branch the cooling medium toward the first liquid inlet and the second liquid inlet.

7. The cooling device according to claim 6, wherein the flowing passage branching portion is disposed at a position away from the first cooling body and the second cooling body.

8. The cooling device according to claim 6, further comprising:

a first conveyor including at least the first conveying belt and the first cooling body;

a second conveyor including at least the second conveying belt and the second cooling body; and a rotary body configured to rotate the second conveyor to move the second conveyor to approach and separate from the first conveyor, wherein the rotary body is disposed closer to the second liquid inlet than the first liquid inlet.

9. The cooling device according to claim 6, wherein the first liquid inlet and the second liquid inlet are disposed facing each other via a sheet conveying passage of the recording medium.

10. An image forming apparatus comprising:

an image forming device configured to form an image on a recording medium; and the cooling device according to claim 6.

* * * * *